US010458199B2

(12) United States Patent
Al-Gouhi et al.

(10) Patent No.: US 10,458,199 B2
(45) **Date of Patent: *Oct. 29, 2019**

(54) SEALING AN UNDESIRABLE FORMATION ZONE IN THE WALL OF A WELLBORE

(71) Applicant: Saudi Arabian Oil Company, Dhahran (SA)

(72) Inventors: Alwaleed Abdullah Al-Gouhi, Dhahran (SA); Nabil S. Alkhanaifer, Dammam (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

This patent is subject to a terminal disclaimer.

(21) Appl. No.: 16/286,865

(22) Filed: Feb. 27, 2019

(65) Prior Publication Data

US 2019/0195041 A1 Jun. 27, 2019

Related U.S. Application Data

(63) Continuation of application No. 16/058,071, filed on Aug. 8, 2018, now Pat. No. 10,280,705, which is a (Continued)

(51) Int. Cl.
*E21B 23/06* (2006.01)
*E21B 33/12* (2006.01)

(Continued)

(52) U.S. Cl.
CPC ..... *E21B 33/1272* (2013.01); *E21B 23/065* (2013.01); *E21B 33/12* (2013.01);

(Continued)

(58) Field of Classification Search
CPC ..... E21B 29/10; E21B 33/12; E21B 43/105; E21B 23/065; E21B 33/127;

(Continued)

(56) References Cited

U.S. PATENT DOCUMENTS 2,519,116 A 8/1950 Crake
2,696,259 A 12/1954 Greene (Continued)

FOREIGN PATENT DOCUMENTS

GB 2251011 6/1992
GB 2411918 A 9/2005

(Continued)

OTHER PUBLICATIONS

International Search Report and Written Opinion in International Application No. PCT/US2017/051272, dated Nov. 24, 2017, 12 pages.

(Continued)

*Primary Examiner* — Daniel P Stephenson
(74) *Attorney, Agent, or Firm* — Fish & Richardson P.C.

(57) ABSTRACT

An inflating container filled with formation plugging fluid is deployed at the target zone by a rigless apparatus. The inflating container can be in valved fluid communication with an explosive filled container, the explosive being ignited using a firing mechanism that is attached to the explosive filled container. The explosion expands gases in the explosive filled container which pass into the inflation container and displace the formation plugging fluid into the balloon sections and through the weakened portions of the central balloon to penetrate the walls of the target zone. The expanded central balloon is melted by the heat of the chemical reaction and a portion adheres to the formation wall thereby sealing the undesirable target zone; thereafter, the remaining balloon sections are deflated or ruptured to permit the apparatus to be withdrawn through the production tubing.

6 Claims, 17 Drawing Sheets

Related U.S. Application Data continuation of application No. 15/701,158, filed on Sep. 11, 2017, now Pat. No. 10,087,708, which is a continuation-in-part of application No. 14/663,812, filed on Mar. 20, 2015, now Pat. No. 10,030,467.

(60) Provisional application No. 62/397,048, filed on Sep. 20, 2016, provisional application No. 61/968,169, filed on Mar. 20, 2014.

(51) Int. Cl.
*E21B 33/127* (2006.01)
*E21B 33/138* (2006.01)
*E21B 34/10* (2006.01)

(52) U.S. Cl.
CPC ..... *E21B 33/127* (2013.01); *E21B 33/138* (2013.01); *E21B 34/10* (2013.01)

(58) Field of Classification Search
CPC .... E21B 33/1272; E21B 33/138; E21B 34/10; E21B 33/1277
See application file for complete search history.

(56) References Cited

U.S. PATENT DOCUMENTS

| | | | |
|---|---|---|---|
| 2,804,148 | A | 8/1957 | Schremp et al. |
| 3,055,424 | A | 9/1962 | Allen |
| 3,354,955 | A | 11/1967 | Berry |
| 3,419,080 | A | 12/1968 | Lebourg |
| 4,074,763 | A | 2/1978 | Stevens |
| 4,349,047 | A | 9/1982 | Ditto |
| 4,462,714 | A | 7/1984 | Smith et al. |
| 5,833,001 | A | 11/1998 | Song et al. |
| 6,102,120 | A | 8/2000 | Chen |
| 6,253,850 | B1 | 7/2001 | Nazzai et al. |
| 6,336,504 | B1 | 1/2002 | Alhanati et al. |
| 6,755,250 | B2 | 6/2004 | Hall et al. |
| 6,860,329 | B1 | 3/2005 | Oosterling |
| 7,370,701 | B2 | 5/2008 | Suijaatmadja et al. |
| 7,708,081 | B2 | 5/2010 | Bosma et al. |
| 8,528,632 | B2 | 9/2013 | Mack |
| 10,087,708 | B2 * | 10/2018 | Al-Gouhi ..... E21B 23/065 |
| 2005/0199401 | A1 | 9/2005 | Patel |
| 2007/0137826 | A1 | 6/2007 | Bosma |
| 2007/0260439 | A1 | 11/2007 | Keller |
| 2008/0060813 | A1 | 3/2008 | Badalamenti et al. |
| 2009/0178809 | A1 | 7/2009 | Keller |
| 2009/0183875 | A1 | 7/2009 | Rayssiguier et al. |
| 2012/0055667 | A1 | 3/2012 | Ingram |
| 2013/0153207 | A1 | 6/2013 | Lauderdale |
| 2015/0267501 | A1 | 9/2015 | Al-Gouhi |
| 2016/0084059 | A1 | 3/2016 | Moore et al. |
| 2016/0177659 | A1 | 6/2016 | Voll |

FOREIGN PATENT DOCUMENTS

| | | | |
|---|---|---|---|
| WO | WO2002099247 | A1 | 12/2002 |
| WO | WO2010127240 | A1 | 11/2010 |

OTHER PUBLICATIONS

International Search Report and Written Opinion in PCT/US2015/021680, dated Sep. 11, 2015, 11 pages.

* cited by examiner

FIG. 1
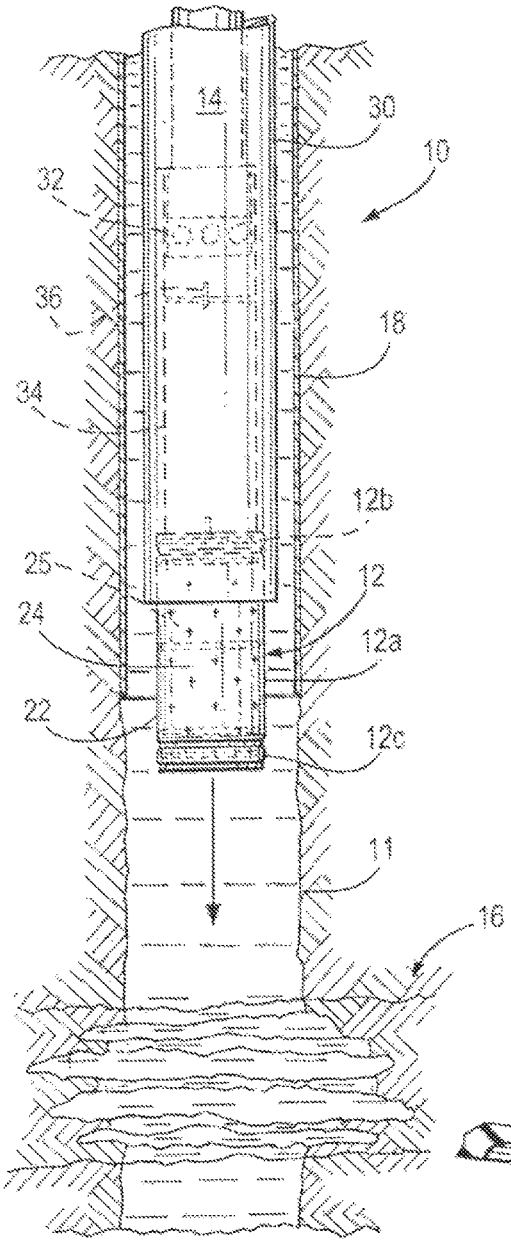
FIG. 3
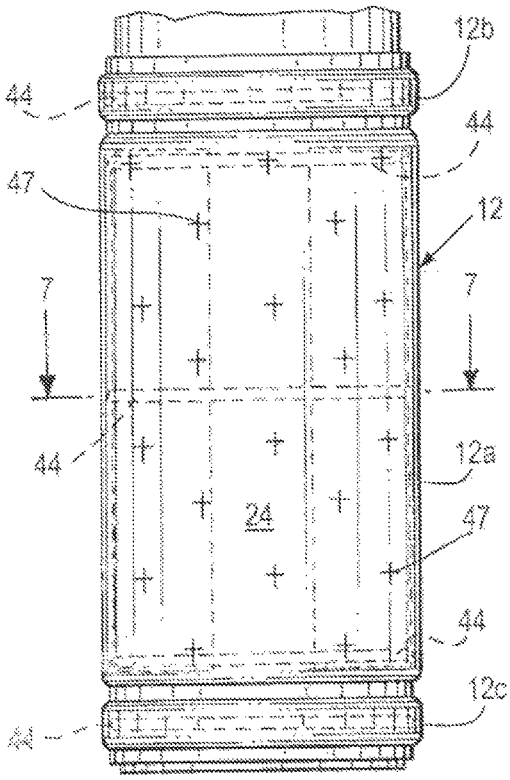
FIG. 4
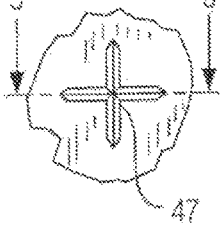
FIG. 5
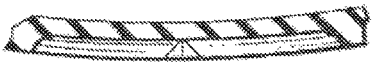
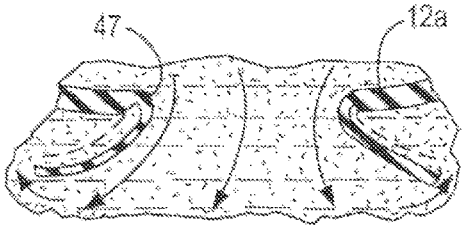
FIG. 6

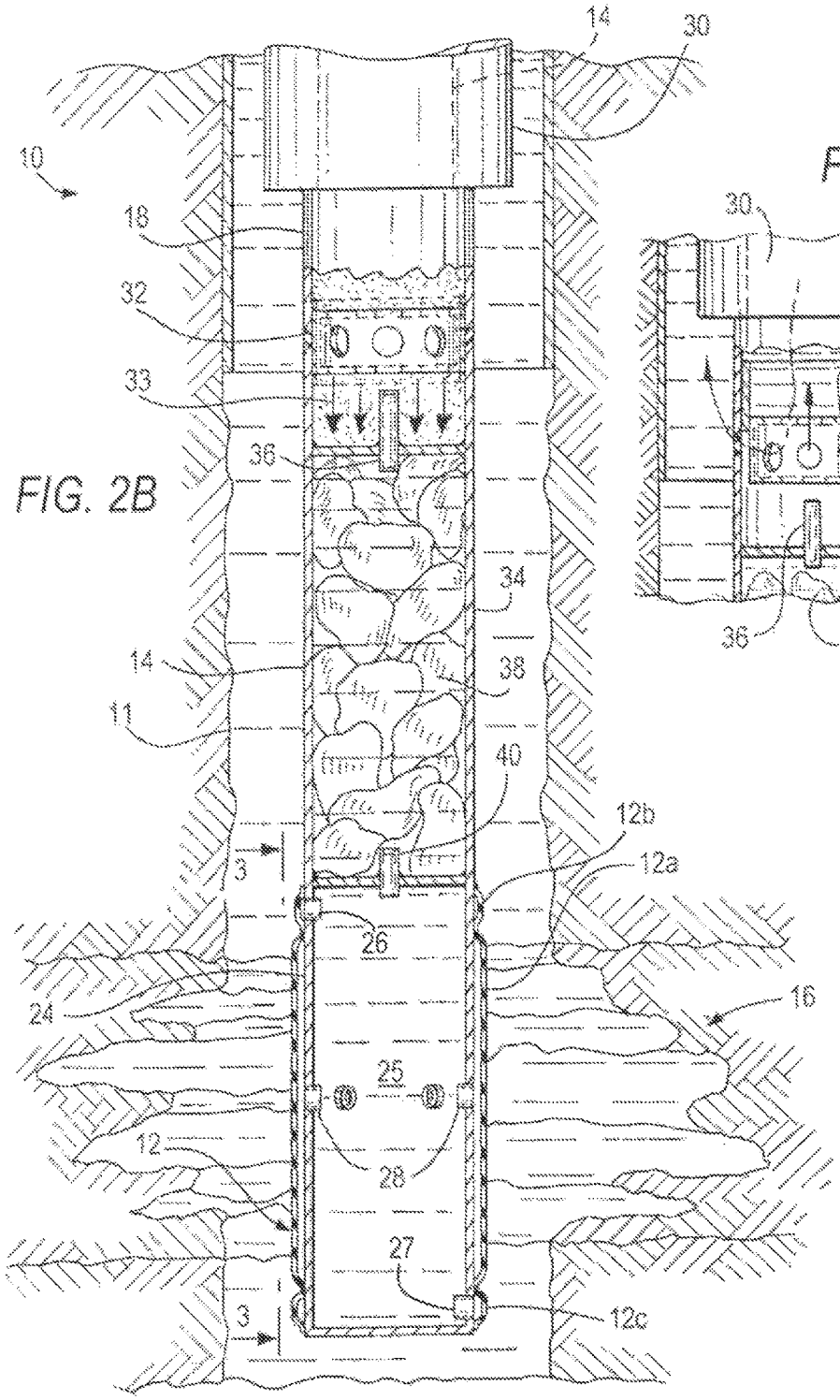
FIG. 2B
FIG. 2A
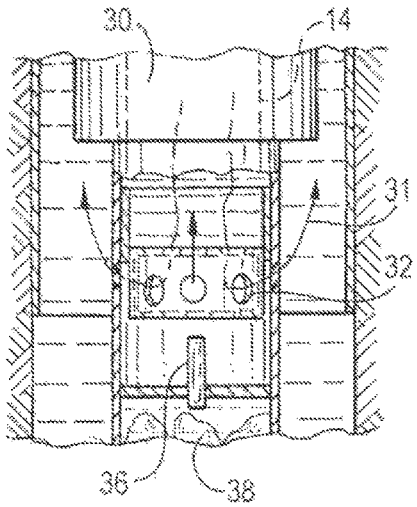

FIG. 7
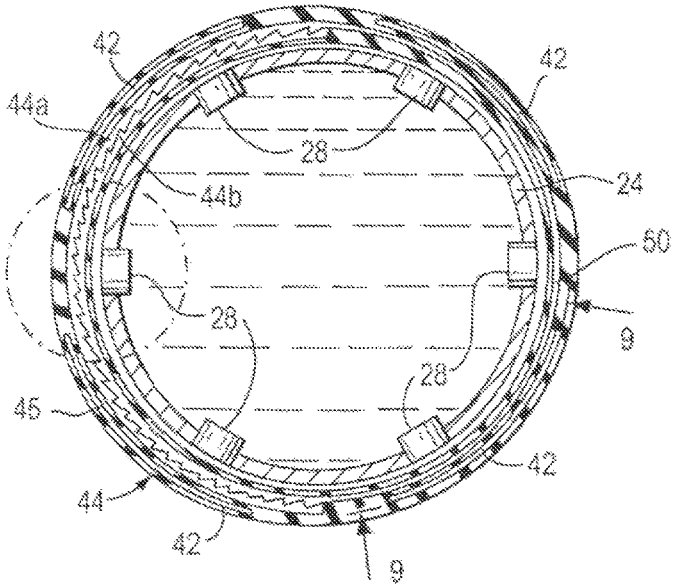
FIG. 9
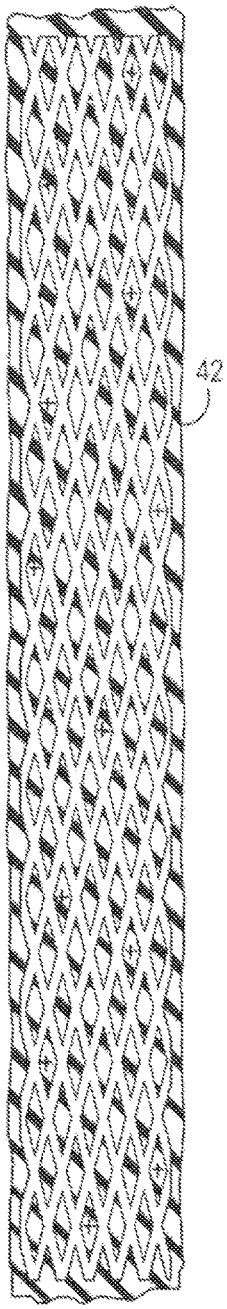
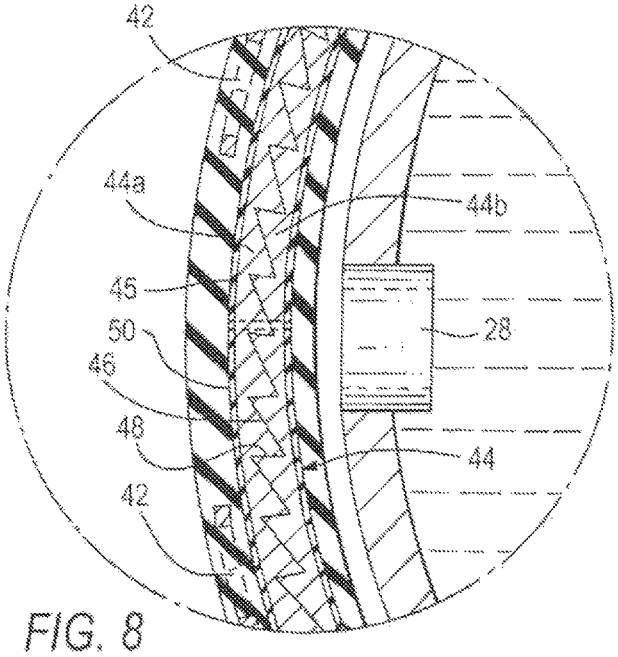
FIG. 8

FIG. 17
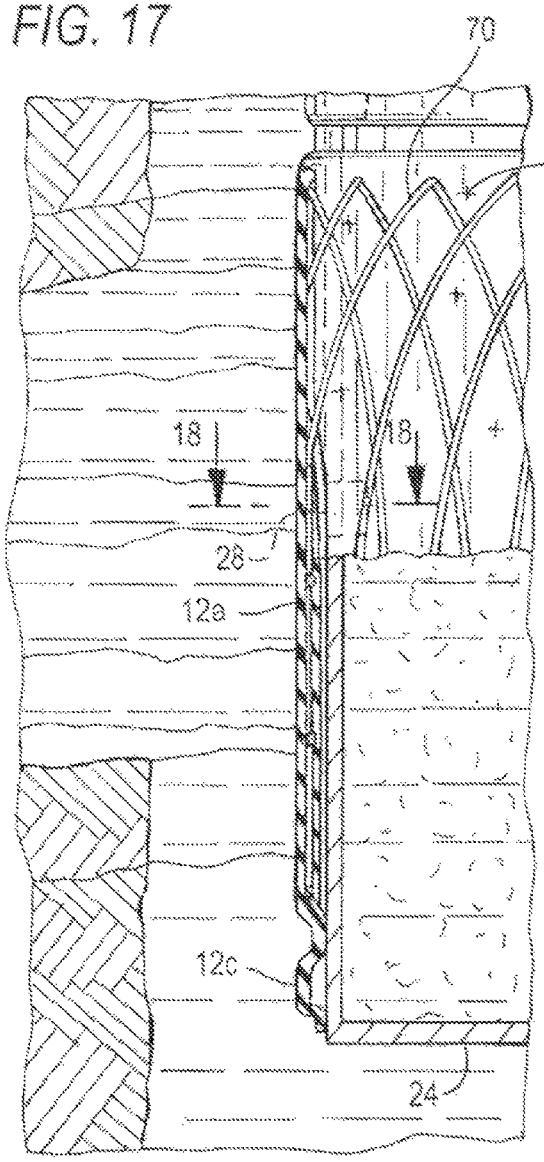
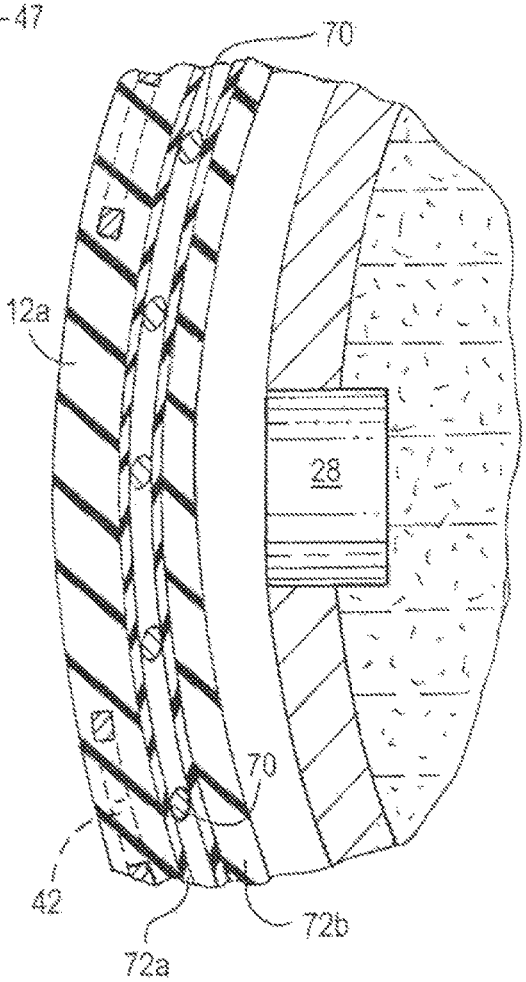
FIG. 18

SEALING AN UNDESIRABLE FORMATION ZONE IN THE WALL OF A WELLBORE

CROSS-REFERENCE TO RELATED APPLICATIONS

This application is a continuation of and claims the benefit of priority to U.S. patent application Ser. No. 16/058,071, filed Aug. 8, 2018 and entitled "SEALING AN UNDESIRABLE FORMATION ZONE IN THE WALL OF A WELLBORE," which is a continuation of and claims the benefit of priority to U.S. patent application Ser. No. 15/701,158, filed Sep. 11, 2017 and entitled "SEALING AN UNDESIRABLE FORMATION ZONE IN THE WALL OF A WELLBORE," which claims priority to Provisional Patent Application Ser. No. 62/397,048, filed Sep. 20, 2016 and entitled "SEALING AN UNDESIRABLE FORMATION ZONE IN THE WALL OF A WELLBORE," which U.S. patent application Ser. No. 15/701,158 is also a continuation-in-part of U.S. patent application Ser. No. 14/663,812, filed Mar. 20, 2015 and entitled "METHOD AND APPARATUS FOR SEALING AN UNDESIRABLE FORMATION ZONE IN THE WALL OF A WELLBORE," which claims priority to U.S. Provisional Application Ser. No. 61/968,169, filed Mar. 20, 2014 and entitled "METHOD AND APPARATUS FOR SEALING AN UNDESIRABLE FORMATION ZONE IN THE WALL OF A WELLBORE," the contents of which are hereby incorporated by reference.

TECHNICAL FIELD

The present disclosure relates to the intentional inducement of downhole formation damage in a target zone to produce deep plugging of the formation matrix and sealing the zone at the wellbore face.

BACKGROUND

Prediction of formation plugging damage that occurs while drilling wells is an important factor in optimizing an oil field's development. The economic impact of near-wellbore drilling-induced damage and cleanup efficiency has led to significant progress in both experimental and numerical studies in order to assess wellbore flow properties during oil production.

The possibility of causing formation permeability plugging damage exists during operations throughout the life of the well. Wellbore damage can cause a reduction in the natural capability of a reservoir to produce its fluids, such as a decrease in porosity or permeability, or both. Damage can occur near the wellbore face which can be relatively easy to repair or deep into the rock which may be difficult to repair.

Damage can occur when sensitive formations are exposed to drilling fluids. Formation plugging damage in a wellbore is generally caused by several mechanisms which can include the following:

1. physical plugging of pores by drilling mud solids;
2. alteration of reservoir rock wettability;
3. precipitation of insoluble materials in pore spaces;
4. clay swelling in pore spaces;
5. migration of fines into pore throats;
6. introduction of an immobile phase; and
7. emulsion formation and blockage.

In well completions, there are several recognized damage mechanisms, such as the invasion of incompatible fluids swelling the formation clays, or fine solids from dirty fluids plugging the formation matrix. Because damage can significantly affect the productivity of any well, adequate precautions should be taken to avoid such damage during all phases in the life of a well.

Natural or induced impairment to production can develop in the reservoir, in the near-wellbore area, or the perforations. Natural damage occurs as produced reservoir fluids move through the reservoir, while induced damage is the result of external operations and fluids in the well, such as drilling, well completion, workover operations, or stimulation treatments. Some induced damage triggers natural damage mechanisms. Natural damage includes phenomena such as fines migration, clay swelling, scale formation, organic deposition, including paraffins or asphaltenes, and mixed organic and inorganic deposition. Induced damage includes plugging caused by foreign particles in the injected fluid, wettability changes, emulsions, precipitates, or sludges caused by acid reactions, bacterial activity, and water blocks. Wellbore cleanup or matrix stimulation treatments are two different operations that can remove natural or induced damage. Selecting the proper operation depends on the location and nature of the damage.

The current practice to shut off a water zone requires a rig to case and cement the entire open-hole and to selectively perforate the oil zone while isolating and maintaining the water zone behind the casing and cement.

In general, formation plugging is considered to be an undesirable phenomenon. The problem to be addressed by the present disclosure is how to utilize these phenomena to plug the porosity and to kill the permeability of a water zone and to retain the oil productive zone in an open hole to allow flow to the wellbore.

SUMMARY

An example implementation of the subject matter described within this disclosure is a wellbore tool with a first container carrying an explosive. An ignition of the explosive causes an expansion of hot gas in the first container. A second container is carrying formation plugging fluid. The second container is attached to the first container. The second container is positioned downhole of the first container. The second container includes an inlet allowing fluid communication between the first container and the second container. An outlet is positioned around a periphery of the second container to flow the formation plugging fluid out of the second container using the expansion of hot gas. An elastomer balloon is attached to an outer surface of the second container. The balloon includes one or more holes around the periphery of the balloon to flow at least a portion of the formation plugging fluid to a wall of a wellbore.

Aspects of the example implementation, which can be combined with the example implementation alone or in combination, include the following. A pressure valve is fluidically connecting the first container and the second container via the inlet of the second container. The pressure valve is configured to open when a pressure of the expansion of hot gas is greater than a threshold pressure on the first container.

Aspects of the example implementation, which can be combined with the example implementation alone or in combination, include the following. A floating piston is positioned in the second container. The floating piston is fluidically exposed to the expansion of hot gas when the pressure valve is in an open position.

Aspects of the example implementation, which can be combined with the example implementation alone or in combination, include the following. The second container includes ways grooved into an inner wall of the second container. The floating piston include a guides positioned in the respective ways to guide the floating piston through the second container.

Aspects of the example implementation, which can be combined with the example implementation alone or in combination, include the following. Shearing pins are positioned in the second container. The shearing pins are positioned to create an interference preventing movement in the floating piston before the expansion of hot gas is flowed into the second container. The port is opened after the expansion of hot gas is flowed into the second container. The floating piston is permitted to be pushed through the second container.

Aspects of the example implementation, which can be combined with the example implementation alone or in combination, include the following. The shear pins have a cross-sectional area and strength so that the shear pins are sheared by the floating piston when moved by the expansion of hot gas.

Aspects of the example implementation, which can be combined with the example implementation alone or in combination, include the following. The balloon is a central balloon. The second container includes an uphole balloon attached to the outer surface of the second container uphole of the central balloon, and a downhole balloon attached to the outer surface of the second container downhole of the central balloon.

Aspects of the example implementation, which can be combined with the example implementation alone or in combination, include the following. A rate of inflation of each of the uphole balloon and the downhole balloon is greater than a rate of inflation of the central balloon.

An example implementation of the subject matter described within this disclosure is a wellbore sealing system with the following featured. An uphole inflatable packer is secured and positioned uphole of a wellbore sealing tool. The uphole inflatable packer is positioned to at least partially fluidically isolate the wellbore sealing tool when in an inflated state. A downhole inflatable packer is secured and positioned downhole of the wellbore sealing tool. The downhole inflatable packer is positioned to at least partially fluidically isolate the wellbore sealing tool when in an inflated stated. A wellbore sealing tool includes a first container carrying an explosive. An ignition of the explosive causes an expansion of hot gas in the first container. A second container is carrying formation plugging fluid. The second container is attached to the first container. The second container fluidically connected to the first container to receive the expansion of hot gas from the first container and to flow the formation plugging fluid out of the second container using the expansion of hot gas. A balloon attached to an outer surface of the second container.

Aspects of the example implementation, which can be combined with the example implementation alone or in combination, include the following. Both the uphole inflatable packer and the downhole inflatable packer each includes an electric pump in fluid communication with fluid in the wellbore.

Aspects of the example implementation, which can be combined with the example implementation alone or in combination, include the following. The second container includes a port through which the formation plugging fluid is flowed into the balloon.

An example implementation of the subject matter described within this disclosure is a method with the following features. An explosion is initiated in a first container carrying an explosive. The first container is positioned inside a well formed in a formation. The explosion expands gas in the first container. An expansion of hot gas flows toward a second container fluidically connected to the first container. The second container is carrying formation plugging fluid configured to prevent fluid flow through the formation. Using the expansion of hot gas, the formation plugging fluid is flowed out of the second container into a balloon attached to an outer surface of the second container. Using the expansion of hot gas, the balloon is inflated. At least a portion of the formation plugging fluid is entrapped between an inner wall of the portion of the well and the balloon. The portion of the well is sealed by melting the inflated balloon.

Aspects of the example implementation, which can be combined with the example implementation alone or in combination, include the following. Initiating the explosion includes directing a spark toward the explosive.

Aspects of the example implementation, which can be combined with the example implementation alone or in combination, include the following. The explosive is a solid explosive or a compressed flammable gas.

Aspects of the example implementation, which can be combined with the example implementation alone or in combination, include the following. The expansion of hot gas is flowed from the first container into the second container in response to a pressure on the first container satisfying a threshold pressure on the first container.

Aspects of the example implementation, which can be combined with the example implementation alone or in combination, include the following. Using the expansion of hot gas, the formation plugging fluid is flowed out of the second container into the balloon attached to the outer surface of the second container. Using the expansion of hot gas, a force is applied on a piston in the second container. The piston causes the formation plugging fluid to flow through a port in the second container into the balloon.

Aspects of the example implementation, which can be combined with the example implementation alone or in combination, include the following. Using the expansion of hot gas, the balloon is inflated. At least a portion of the formation plugging fluid is entrapped between the inner wall of the portion of the well and the balloon. The formation plugging fluid is flowed through an opening in the balloon toward the portion of the well. A rate of inflation of the balloon is delayed until at least a portion of the formation plugging fluid has flowed through the opening in the balloon toward the portion of the well.

BRIEF DESCRIPTION OF THE DRAWINGS

Preferred embodiments of the disclosure are described in more detail below and with reference to the drawings in which:

FIG. 1 is an elevation view, partially in cross-section, of an apparatus constructed according to the present disclosure, the chemical balloon having three inflatable sections being deployed in an open-hole section of a wellbore supported by coiled tubing and positioned below the end of the production tubing, the wellbore having an undesirable water zone and being filled with formation fluid or other completion fluid denoted herein as "wellbore fluid";

FIG. 2A is an enlarged partial cross-sectional view of an uphole portion of the apparatus of FIG. 1, illustrating the displacement of wellbore fluid through the circulation valve once the apparatus has been lowered to the target zone;

FIG. 2B is an enlarged partial cross-sectional view of the components of the apparatus of FIG. 1, illustrating the mechanism used for initiating the chemical reaction which expands the central balloon;

FIG. 3 is an enlarged side elevation view of the multi-section chemical balloon which forms part of the apparatus of FIG. 1 and delivers formation plugging fluid to the target zone;

FIG. 4 is an enlarged fragmentary view of a section of the central balloon shown in FIGS. 1 and 3, illustrating one of several weakened sections of the balloon that permit wall formation plugging fluid material to pass from the inflating container and through the weakened sections of the central balloon to penetrate the formation and seal the target zone while the balloon is inflating;

FIG. 5 is a cross-sectional view, taken along lines 5-5 of FIG. 4, showing a portion of the weakened central balloon wall having a reduced thickness;

FIG. 6 is a partial cross-sectional view of a portion of the central balloon wall shown in FIGS. 4 and 5, when ruptured during inflation allowing the pressurized formation plugging material reaction products to pass through the balloon wall into the annulus to seal the target zone;

FIG. 7 is a cross-sectional view, taken along lines 7-7 of FIG. 3, illustrating an embodiment of the disclosure in which two or more expandable ratchet rings are embedded in the central balloon to provide circumferential rigidity to selected portions of the balloon as it expands during the chemical reaction and to maintain it in the fully expanded position against the wellbore wall following expansion;

FIG. 8 is an enlarged view of the indicated portion of FIG. 7 illustrating the engagement of the ratchet rings;

FIG. 9 is a cross-sectional view, taken along lines 9-9 of FIG. 7, of one embodiment of a rigid reinforcing band in the form of a diamond-shaped mesh metal strip embedded in the central balloon material to provide rigidity in the longitudinal direction to complement the circumferential rigidity provided by the expandable ratchet rings shown in FIGS. 3 and 7;

FIG. 17 is an elevation view, partly in cross-section of another embodiment illustrating the inclusion of an expandable wire stent device in the un-inflated balloon which will maintain the fully expanded central balloon against the wall of the wellbore;

FIG. 18 is a cross-sectional view, taken along lines 18-18 of FIG. 17, showing the expandable wire stent device positioned between two extensible webs of a polymeric material that are embedded in the wall of the central balloon;

DETAILED DESCRIPTION OF THE PREFERRED EMBODIMENTS

Figure 11:
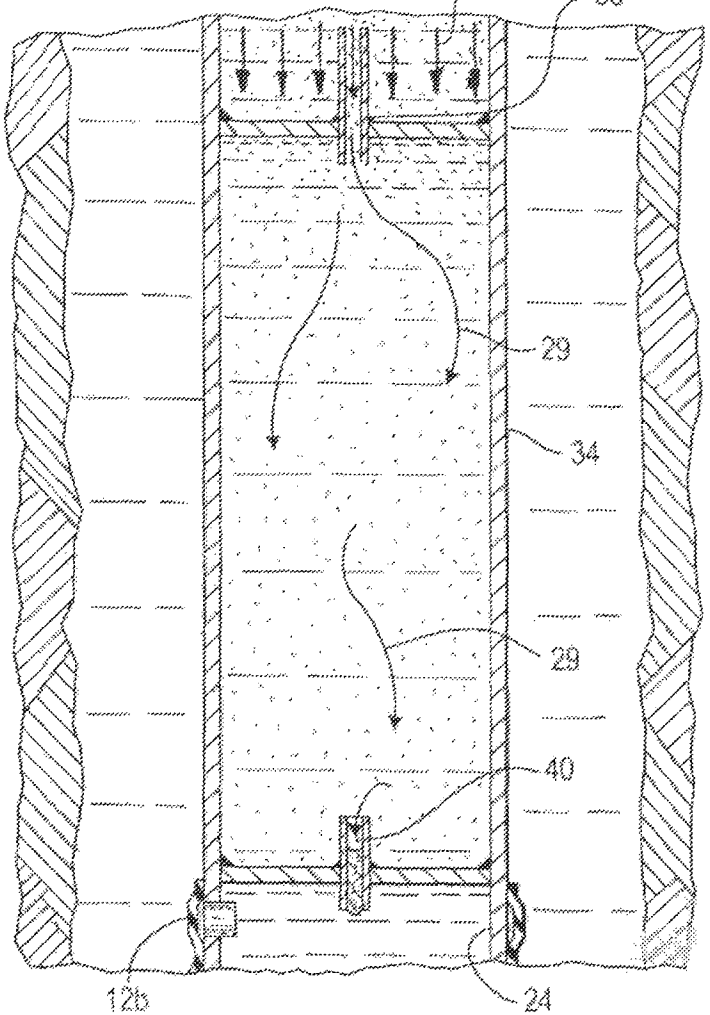
FIG. 11 is a cross-sectional view of the chemical container shown in FIGS. 2 and 10 in the process of initiating the reaction prior to discharging the pressurized reaction products via the downhole pressure valve to inflate the balloons.

Referring now to the drawings, and specifically to FIG. 1, there is shown in elevation and partially in cross-section, an apparatus 10 constructed according to one embodiment of the present disclosure. The apparatus includes a resilient inflatable component, referred to generally as balloon 12, which is comprised of a plurality of sections and, as illustrated, of three sections, there being a central section 12*a*, referred to as the main or middle, or central balloon, an uphole balloon 12*b*, and a downhole balloon 12*c*. In the description which follows, reference to balloon 12 contemplates the balloon in its entirety, including the three sections, 12*a*, 12*b*, and 12*c*, where balloon 12*a* is the central or middle balloon. The three sections are inflated according to a predetermined sequence as will be described in greater detail below.

The un-inflated balloon 12 and related components described below are deployed in the wellbore 11 by coiled tubing 14 which passes through production tubing 30 until it reaches target zone 16 of the wellbore. For purposes of describing this embodiment, target zone 16 will be denoted as an "undesirable" water zone. In FIG. 1, undesirable target zone 16 is located deeper in the wellbore 11 than the downhole end 22 of production tubing 30 and well casing 18.

The undesirable zone 16 may also represent a lateral drill hole which may be horizontal or angled, and which may have been partially damaged by one or more of a number of factors, including, but not limited to, contact with wellbore fluids used during drilling/completion and workover operations. It is a zone of reduced permeability within the vicinity of the wellbore 11 (i.e., skin), often the result of foreign fluid invasion into the reservoir rock.

The three balloons 12*a*, 12*b*, and 12*c* can be made of any suitable flexible thermoplastic expandable material, i.e., a polymer, and preferably rubber, natural or synthetic. Different flexible and resilient materials can be used for each of the three balloons and/or the individual balloons can be produced with different wall thicknesses, physical properties and means for attachment to their supporting surface. The thickness and resiliency of the walls, or sections of the walls of the respective balloons, is sufficient to permit the expansion and secure contact with the adjacent wall surface.

As will be described in greater detail below, the balloons 12 are inflated via an exothermic reaction in the chemical container 34 which is initiated by the pumping of a predetermined volume of a fluid reactant 33 (not shown) from the surface via the coiled tubing 14 and through the uphole pressure-operated inlet valve 36 into the chemical container 34 and into contact with one or more reactant material(s) loaded in the chemical container 34 during preparation of the apparatus before it is lowered into the wellbore 11. The inflating container 24 is also filled at the surface with formation plugging fluid 25 and has at least three inflating ports. In the preferred embodiment, the three balloons are secured in position on the outside surface of the inflating container 24, e.g., by an adhesive. The central balloon preferably has a plurality of weakened areas that will rupture at the early stages of inflation. After rupturing, the weakened wall will allow the passage of the formation plugging fluid from the inflating container 24, while allowing the balloon 12 to inflate and expand radially into the annular space or compartment defined by the adjacent balloons.

The uphole and downhole balloons 12*b* and 12*c* will inflate first to provide tight seals against the wall of the well at either end of the central balloon, thereby acting as barriers to the formation plugging fluid 25. This fluid-tight compartment will permit the formation plugging fluid 25 to be forced deep into the formation under the pressure produced by the hot rapidly expanding reaction product. As noted, initially, the wellbore 11 is filled with formation fluids or other completion fluids which are referred to herein as "wellbore fluid."

Referring now to FIGS. 2A and 2B in conjunction with FIG. 1, the balloon 12 is positioned and supported by inflating container 24, which includes a plurality of inflating valves 26, 27, and 28, which, when open, permit passage of the formation plugging fluid 25 under pressure, and expand the three sections 12*a*, 12*b*, and 12*c* of balloon 12 when the reaction products from above enter the container 24 is described in greater detail in the discussion of FIGS. 11-14.

Referring again to FIGS. 2A and 2B in conjunction with FIG. 1, the assembly of the disclosure includes coiled tubing 14 deployed via production tubing 30 into the borehole which is attached at its downhole end to timed circulation valve 32 which in turn, is attached to chemical container 34, which is secured in fluid communication via pressure valve 40 to inflating container 24. The circulation valve can be any type of programmable circulation valve which is manufactured for oil drilling applications, such as the Halliburton eRED-HS® Remotely Operated Circulating Valve or the Omega Remote Completion Circulating valve. The timed circulation valve 32 is kept open while the tool is lowered into the borehole so that wellbore fluids enter the coiled tubing, thereby facilitating deployment of the assembly through production tubing 30.

The chemical container 34 can contain any suitable chemical reactant(s) 38 that can be activated to produce an exothermic reaction and preferably provide a limited or controlled "explosive" expansion by the addition of a fluid reactant as an activating medium. In the present example, the chemical container 34 preferably houses a supply of pure solid reactant material, such as sodium metal 38, which can later be activated by an appropriate amount of water delivered via the coiled tubing from the surface under pressure to initiate the necessary reaction with sufficient force to rapidly expand the rubber balloons 12. For safe handling, the sodium metal can be submerged in kerosene or other non-reactive liquid in the sealed chemical container 34. Other appropriate known reactant materials are contemplated as within the scope of the disclosure, provided that they are capable of producing a rapid exothermic reaction.

Once the balloon 12 reaches the target zone 16, a predetermined volume of activating fluid reactant 33 that is required to complete the highly exothermic reaction with the chemical(s) inside the chemical container 34 is pumped into the coiled tubing 14 from the surface. The fluid reactant is followed by a displacing liquid (not shown) which is pumped into the coiled tubing 14 to displace wellbore fluids 31 through the timed circulation valve 32 as is illustrated in FIG. 2A. The timed circulation valve 32 is programmed so that the circulation valve timer (not shown) accounts for the time required for the activating fluid reactant 33 to be pumped from the surface to the circulation valve depth. When the fluid reactant 33 reaches the timed circulation valve 32, pumping may be stopped while the timed circulation valve 32 automatically closes, after which, additional displacing fluid is pumped into the coiled tubing to raise the pressure to a sufficient level to open pressure-operated inlet valve 36 which is positioned on chemical container 34. Alternatively, the flow of fluids may be continuous and the circulation valve will automatically change the flow pattern to permit the fluid reactant to develop sufficient pressure to open inlet valve 36.

Referring again to FIG. 2B, the pressure-operated inlet valve 36 is set to open at a predetermined pressure, thereby allowing the activating fluid reactant 33, e.g., water, to enter the chemical container 34 and react with the reactant chemical, e.g., sodium metal 38, initiating the controlled explosive reaction within chemical container 34.

Pressure-operated exit valve 40 is positioned at the bottom of the chemical container 34 and communicates with the inflating container 24. The pressure-operated exit valve 40 is set to open under the pressure generated by the chemical reaction and permit the hot pressurized reaction products to enter the inflating container 24.

Upon entry of the reaction products into inflating container 24, the three pressure-operated inflating valves 26, 27, and 28 open to permit the formation plugging fluid 25 to exit the inflating container and begin inflating the three sections of the balloon 12 according to the predetermined sequence described above. The central balloon 12*a* inflates at a lower rate because of its relatively greater volume, while the adjacent smaller balloons 12*b* and 12*c* will be fully inflated first and provide the required seals with the wellbore wall to isolate the target zone 16. This filling sequence can also be achieved by varying the size or flow rate of the plugging fluid through the valves to the respective balloons 12*b* and 12*c*, and/or by lowering the pressure setting at which the valves 26 and 27 open. With reference to FIG. 3, the formation plugging fluid begins to pass through the weakened sections 47 in the central balloon 12*a* as the pressure and volume inside increases. As will be described in greater detail below, the expandable ratchet rings 44 also expand to provide circumferential support following the completed inflation of the central balloon 12*a* against the wall.

The functioning of the weakened sections 47 in the central balloon 12*a* is illustrated in FIGS. 4-6. FIG. 4 is an enlarged view of weakened section 47 of the central balloon 12*a*. As shown in FIG. 5, a cross-sectional view taken along lines 5-5 of FIG. 4, the balloon wall is of a reduced thickness. As shown in FIG. 6, the rupturing of the weakened section 47 of the balloon wall allows formation plugging fluid to escape through the balloon wall 12*a* in order to seal the target zone.

Figure 13:
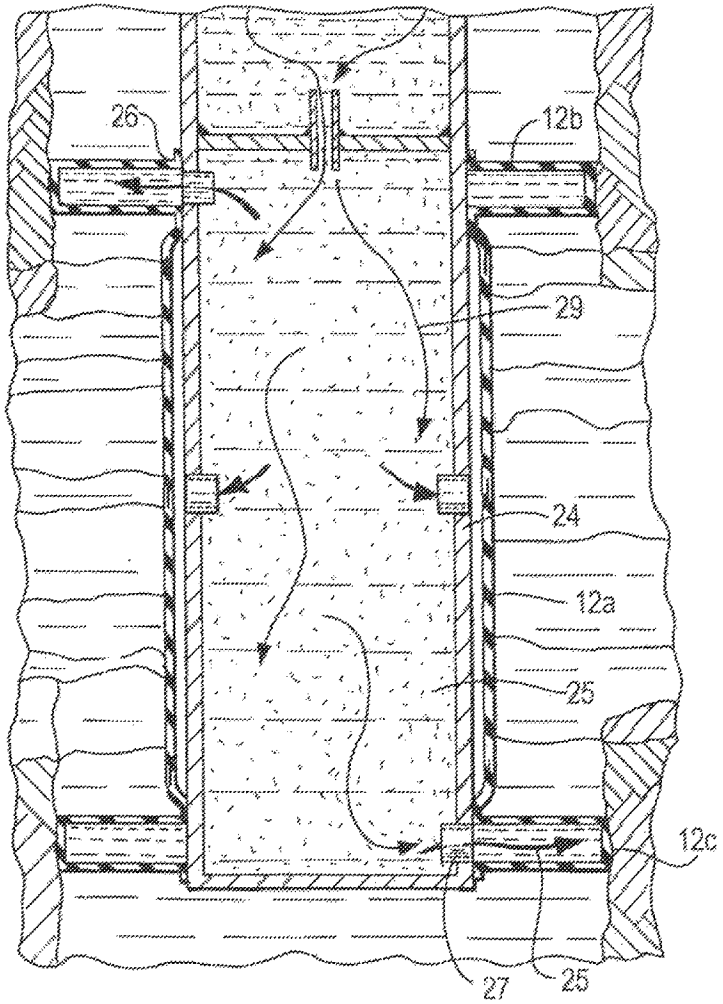
FIG. 13 is a cross-sectional view similar to FIGS. 11 and 12, illustrating the inflating of the three balloons at an intermediate stage with the uphole and downhole barrier balloons fully inflated in sealing contact with the wellbore wall to form a compartment with the central balloon partially inflated.

Again referring to FIG. 2B, in a further preferred embodiment, inflating valves 26, 27, and 28 can be of different sizes and/or permit different flow rates in order to more rapidly inflate balloons 12*b* and 12*c*. The inflating valves 26, 27, and 28 are opened by controlled explosive force of the chemical reaction, and permit the reaction products to displace the plugging fluid and the balloons 12*a*, 12*b*, and 12*c* to displace the formation plugging liquid in the inflating container 24, and to inflate to their positions in contact with the wall of the wellbore 11 as best shown in FIG. 13. Uphole and downhole balloons 12*b*, 12*c* are end balloons which inflate faster than central balloon 12*a* and provide stability to the entire installation while sealing the uphole and downhole spaces between the inflating container 24 and the wellbore 11. Although pressure-operated inflating valves 26, 27 can open at the same time as pressure-operated valve 28, expansion of central balloon 12*a* is not to be as rapid as uphole and downhole balloons 12*b* and 12*c*.

It should be noted that alternative valve arrangements, such as pre-programmed RFID tags operated by radio frequency and pumped tags provided from the surface with prior art electronically actuated valves, can also be incorporated into the present disclosure by one of ordinary skill in the art. However, the pressure-operated valves as described above, are presently preferred. The pressure operated valve is a conventional injection-pressure-operated valve such as those manufactured by Schlumberger and Halliburton.

As noted above, the openings 47 in the sidewall of the body of the central balloon 12*a* will allow the passage of the pressurized formation plugging fluid from the inflating container 24 into the annulus between expanding balloon 12*a* and the wellbore wall, while also causing the balloon to inflate at a slower rate than the uphole and downhole balloons, 12*b* and 12*c*.

Figure 14:
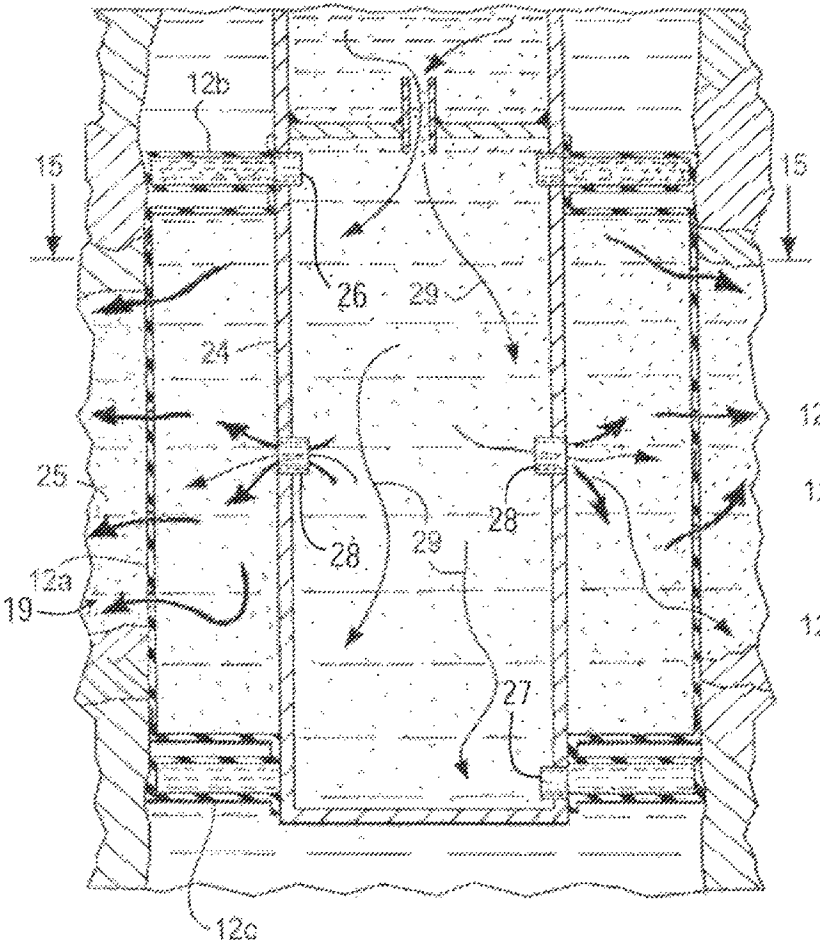
FIG. 14 is a cross-sectional view similar to FIG. 13 illustrating the sequential entry of the reacting chemicals and displacement of the formation plugging fluid into the central balloon via the inflating valves located in the sides of the inflating container that supports the balloons, to expand the uphole and downhole balloons, and permit the plugging fluid to pass through the ruptured weakened portions of the central balloon and penetrate the formation after which the hot reaction product softens and melts the balloon while it is against the wall of the well to seal off the target water zone.

The formation plugging fluid 25 is initially in the inflating container 24. As shown in FIG. 14, the formation plugging fluid 25 is displaced to the inflating container through inflation valves 26, 27, and 28 by the force or pressure produced by chemical reactants 29 coming from the chemical container 34 above it and with which it is in fluid communication. As it is displaced, the formation plugging fluid 25 and the chemical reactants 29 inflate the balloons 12*a*, 12*b*, and 12*c*, and enter the annulus through the one or more openings 47 in the central balloon. The formation plugging fluid 25 can be of any suitable known type that is consistent with and functions to seal the particular formation well under the prevailing conditions. The wellbore fluid originally in the annulus 19 will be displaced into the pores and fissures of the adjacent reservoir rock by the formation plugging fluid 25 as it enters the annulus 19 from the openings 47 in the central balloon 12*a*.

Figure 16:
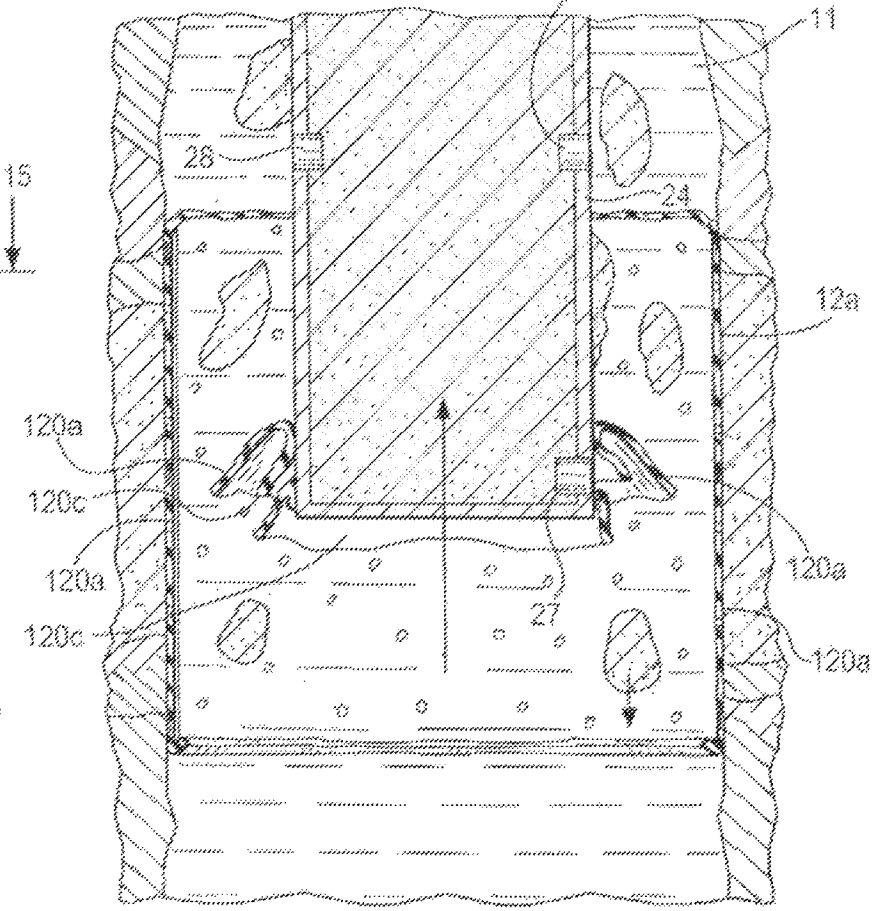
FIG. 16 is a cross-sectional view similar to FIG. 14 showing the completion of the wall sealing process and the partial withdrawal into the production tubing of the coiled tubing, the inflating container, the chemical container, and the residual material of the uphole and downhole balloons following their rupture.

As shown in FIG. 16, after inflation of the central balloon 12*a*, and forcing the formation plugging fluid 25 into the formation wall, the hot reaction products 29 will cause the central balloon 12*a* to burst at its uphole and downhole periphery, soften and melt against the wall of the wellbore 11. A large portion of the central balloon 12*a* will be melted and in full contact with the wall of the well after its maximum inflation. The longitudinal portion of the central balloon is thus separated from attachment to the exterior of the inflating container.

With reference to FIG. 14, the structure of the uphole and downhole balloons 12*b*, 12*c* are stronger than the structure of the central balloon 12*a* due to the plurality of weakened sections 47 which are ruptured when the reaction takes place. The weakened sections 47 in the central balloon 12*a* will also permit the wall plugging fluid to pass through the ruptured portions and penetrate the wall behind the elastomeric polymer material of the central balloon 12*a*.

Figure 15:
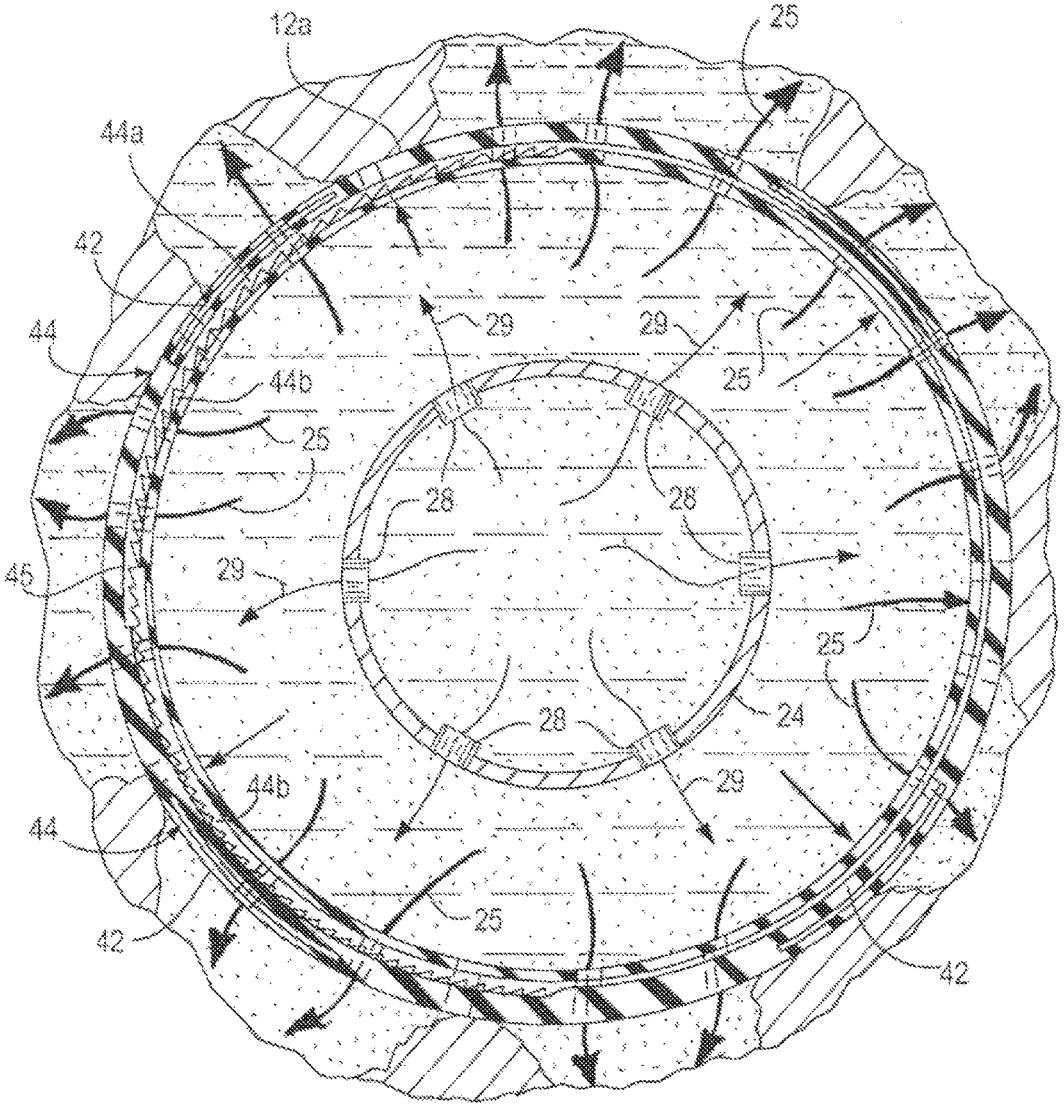
FIG. 15 is a cross-sectional view, taken along lines 15-15 of FIG. 14, illustrating the expanded and separated melted portion of the central balloon and the corresponding expansion of the toothed ratchet ring outwardly to a position which stabilizes and maintains the expanded diameter of the separated portion of the central balloon, with the diamond mesh providing stability in the longitudinal direction.

Referring to the stage illustrated in FIG. 15, as the central balloon 12*a* expands, it pushes the original wellbore fluid and the formation plugging fluid that was inside the inflating container 24 deep into the formation.

At this stage of the process, the body of the central balloon 12*a* is fully exposed to the heat generated in the exothermic chemical reaction from chemical container 34 directly above it. As noted, the heat of the reaction product melts the central balloon 12*a* against the wall of the well, and at the same time, it will be retained in position by the expandable ratchet rings 44 and supported longitudinally by the rigid bands or straps 42. The uphole and downhole balloons 12*b*, 12*c* are not affected by the exothermic reaction because they are initially fully inflated by the formation plugging fluid and there is no aperture in either of these annulus-sealing balloons through which the plugging fluid can escape.

Again referring to FIG. 16, after the completion of the wall sealing or plastering step, pressurized fluid is pumped from the surface through the coiled tubing to rupture the uphole and downhole balloons 120*b* (not shown), 120*c* to enable the apparatus to be retrieved through the production tubing 30.

After the parting of the central balloon 120*a* and the bursting of the uphole and downhole balloons 120*b*, 120*c*, the coiled tubing can be withdrawn from the wellbore 11 with the remnants of the central, uphole, and downhole balloons 120*b*, 120*c*, leaving the principal portion of central balloon 120*a* in position to seal the undesirable water zone of the wellbore 11.

Referring to FIGS. 7-9, at least the central balloon is preferably strengthened both circumferentially and longitudinal by the addition of reinforcing components. For longitudinal rigidity, a plurality, e.g., four or more rigid reinforcing bands or straps 42, e.g., of metal diamond mesh, are embedded in the polymeric material in spaced-apart relation about the periphery as shown in FIGS. 7-9.

For circumferential strength, an expandable ratchet ring 44 is positioned within open-ended tube 45 which is embedded in, or bonded to, the interior surface of the circumference of the central balloon 12*a*. It is preferable to position ratchet right ring at either end of the central balloon to hold it firmly in position when expanded against the wall above and below the target zone. One or more additional transverse ratchet rings can be provided based on the longitudinal length of the target zone that must be covered by central balloon 12*c*.

The expandable ratchet ring 44 is comprised of two metal rings 44*a*, 44*b*, having overlapping teeth on the inner facing sides as best shown in FIG. 8. The teeth are generally uniform, but asymmetric, with each tooth having a moderate angular slope 46 on one side, and a steeper slope 48 on the other side. The moderate angular slope 46 on one side allows the overlapping teeth to slide over each other during expansion of the balloon 12, and the steeper slope 48 prevents the ring 44 from collapsing after expansion of balloon 12, and retains the ratchet ring 44 in the expanded configuration. As noted, and as best shown in FIG. 8, the ratchet ring 44 is contained inside an open-ended flexible circular tube 45, the ends of the opening 50 initially facing each other. The flexible tube 45 constrains the ratchet ring 44 and keeps the teeth of the ratchet ring 44 in engagement at all times after expansion of the central balloon 12*a*. The opening 50 of the tube 45 allows the expansion of the ring inside the tube, as the two facing ends of the tube opening move away from each other.

Figure 19:
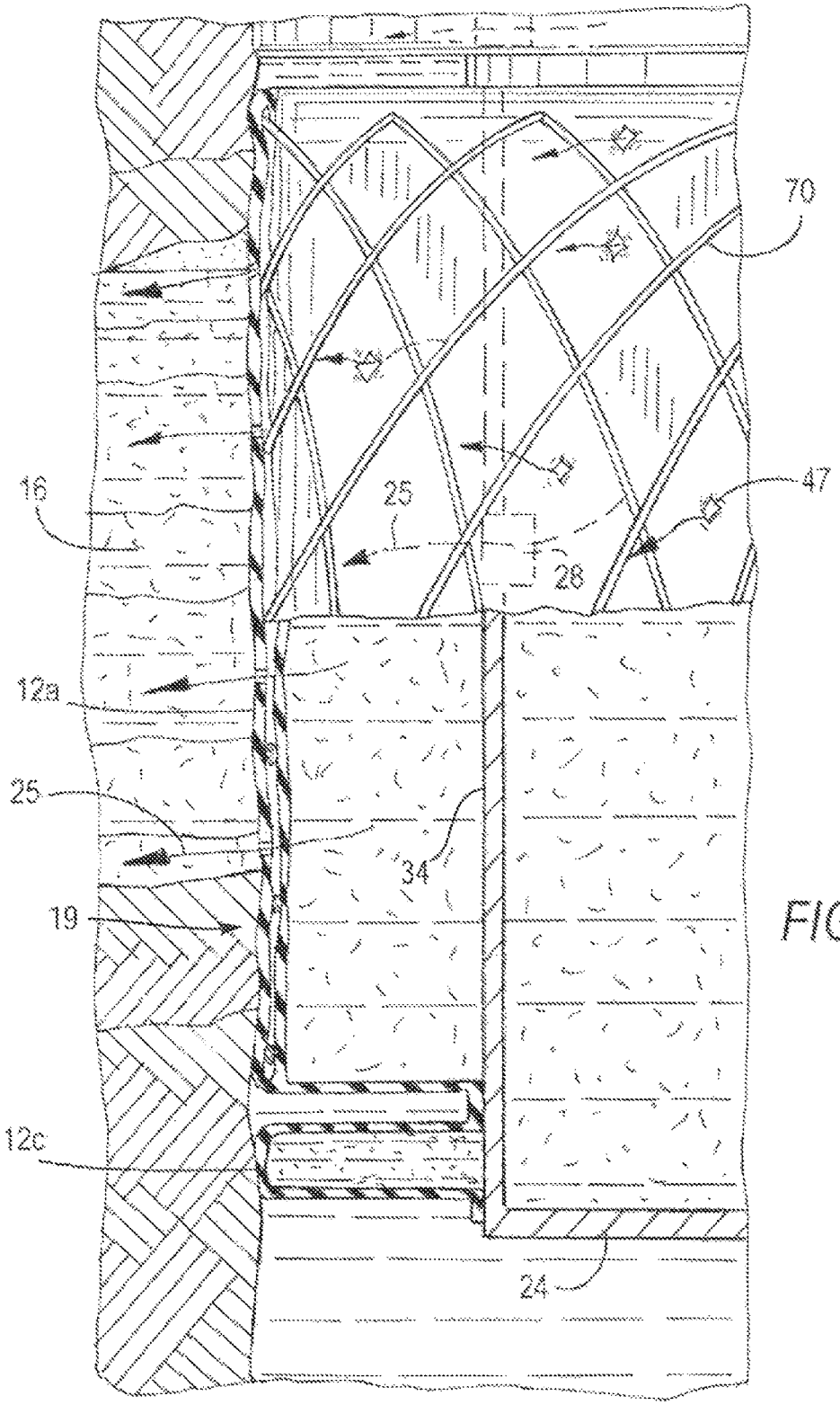
FIG. 19 is a view similar to FIG. 17 illustrating the full expansion of the central balloon and the expanded wire stent device against the formation wall.

Referring to FIGS. 17-19, in another embodiment of the disclosure, an expandable wire stent device 70 is utilized to maintain the fully expanded central balloon against the wall of the wellbore. FIG. 17 illustrates the embodiment utilizing the expandable wire stent device 70, prior to initiation of the chemical reaction described above, where central balloon 12*a* and expandable stent device 70 have not yet been expanded by passage of formation plugging fluids from the inflating container 24 into the central balloon 12*a* through pressured-operated inflation valve 28.

As shown in the enlarged cross-sectional visual of FIG. 18, the expandable wire stent device 70 is positioned between two webs 72*a*, 72*b* and embedded in the walls of the central balloon 12*a*. Similarly to the embodiment illustrated in FIGS. 7-9, additional longitudinal support may be provided by rigid reinforcing bands or straps 42 which are also embedded in the walls of the central balloon 12*a*.

With reference to FIG. 19, upon initiation of the chemical reaction as discussed above with reference to FIG. 2B, the formation plugging fluid 25 is forced through pressure-operated inflation valves 26, 27, and 28, thereby expanding the balloons 12*a*, 12*b*, and 12*c*. As the central balloon 12*a* expands, so does the extendable wire stent device 70 and the webs 72*a* and 72*b*. The webs 72*a* and 72*b* are fabricated from an extensible material that will stretch as the balloon and the wire stent expands. Polymers and copolymers of vinyl, polyethylene, and polypropylene can be used. When the pressure in the central balloon 12*a* reaches a sufficient level, formation plugging fluids 25 pass through the ruptured weakened sections 47 of the central balloon, after which they penetrate the formation in the target zone 16. As in the embodiment described in FIG. 15, once the central balloon 12*a* and expandable stent device 70 are fully expanded against the wall surface, the heat of the reaction product softens and melts the central balloon 12*a* against the wall of the well, and is maintained in position by the expandable wire stent device 70 and supported longitudinally by the rigid bands or straps 42 shown in FIG. 18.

Referring to FIGS. 20-23, in an alternative embodiment of the disclosure, the uphole and downhole balloons used to isolate target zone 16 are replaced by a dual inflatable packer system which includes an uphole inflatable packer 80*a* and a downhole inflatable packer 80*b*, each of which are inflated with wellbore fluid 31 by separate electric pumps 82*a* and 82*b*. The packers are constructed of a reinforced rubber composition for durability during repeated usage of the assembly. Electrical wiring (not shown) extends from each of the packers to the wellhead where controls for the pumps are provided. Inflatable packers are well known in the art and can be adapted by one of ordinary skill for use in this configuration of the present disclosure.

Figure 20:
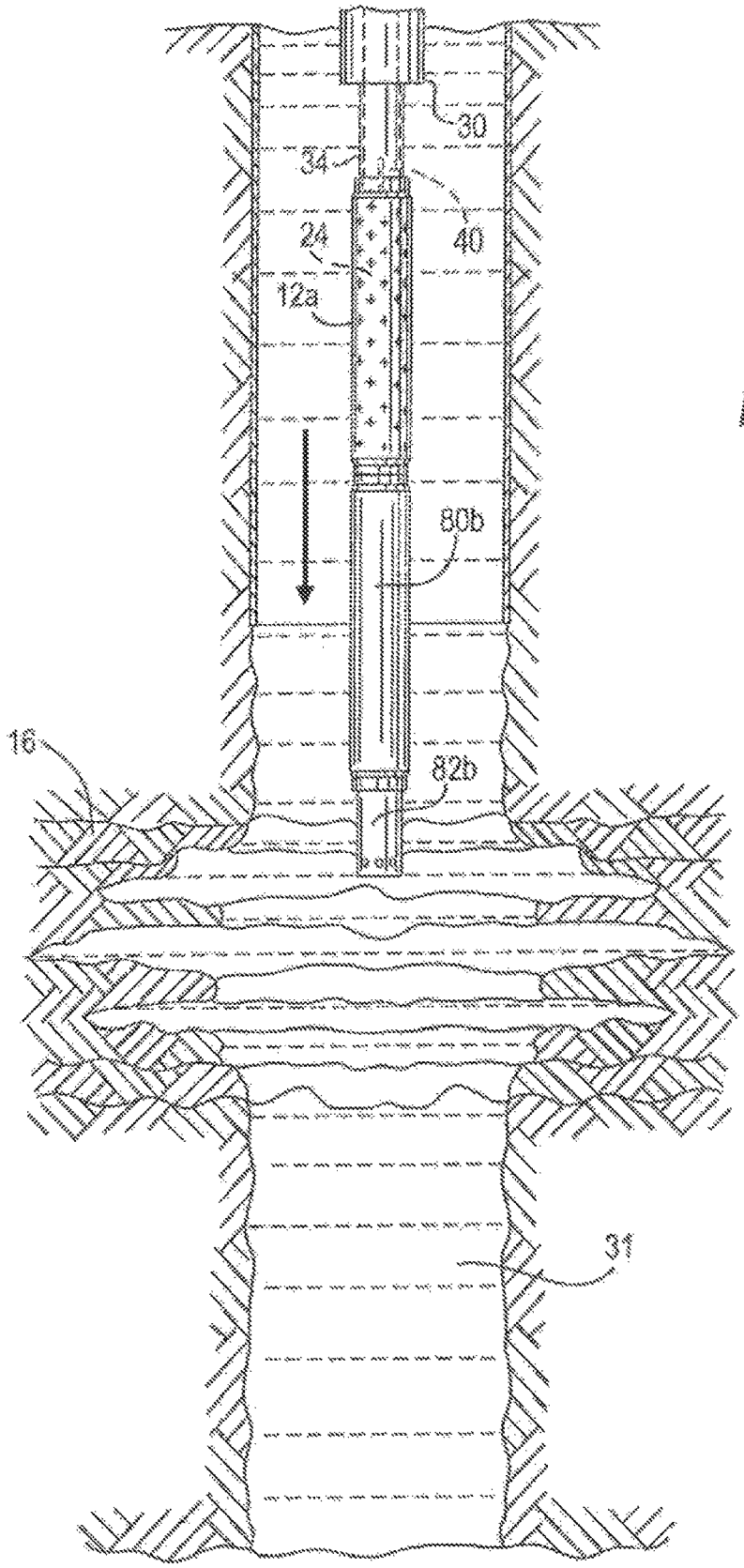
FIG. 20 is an elevation view, partly in cross-section, of another embodiment which includes dual inflatable packers in place of the uphole and downhole balloons, illustrating the lowering of the apparatus into position in the target zone.

FIG. 20 illustrates the lowering of the assembly utilizing the dual inflatable packer system through the production tubing 30 via the coiled tubing (not shown). The apparatus is lowered until the inflating container 24 and central balloon 12*a* are aligned with the target zone 16. As explained with respect to FIGS. 2A and 2B, the circulation valve 32 (not shown) is kept open while the tool is lowered into the borehole so that wellbore fluids enter the coiled tubing, thereby facilitating deployment of the assembly through the production tubing 30.

Figure 21:
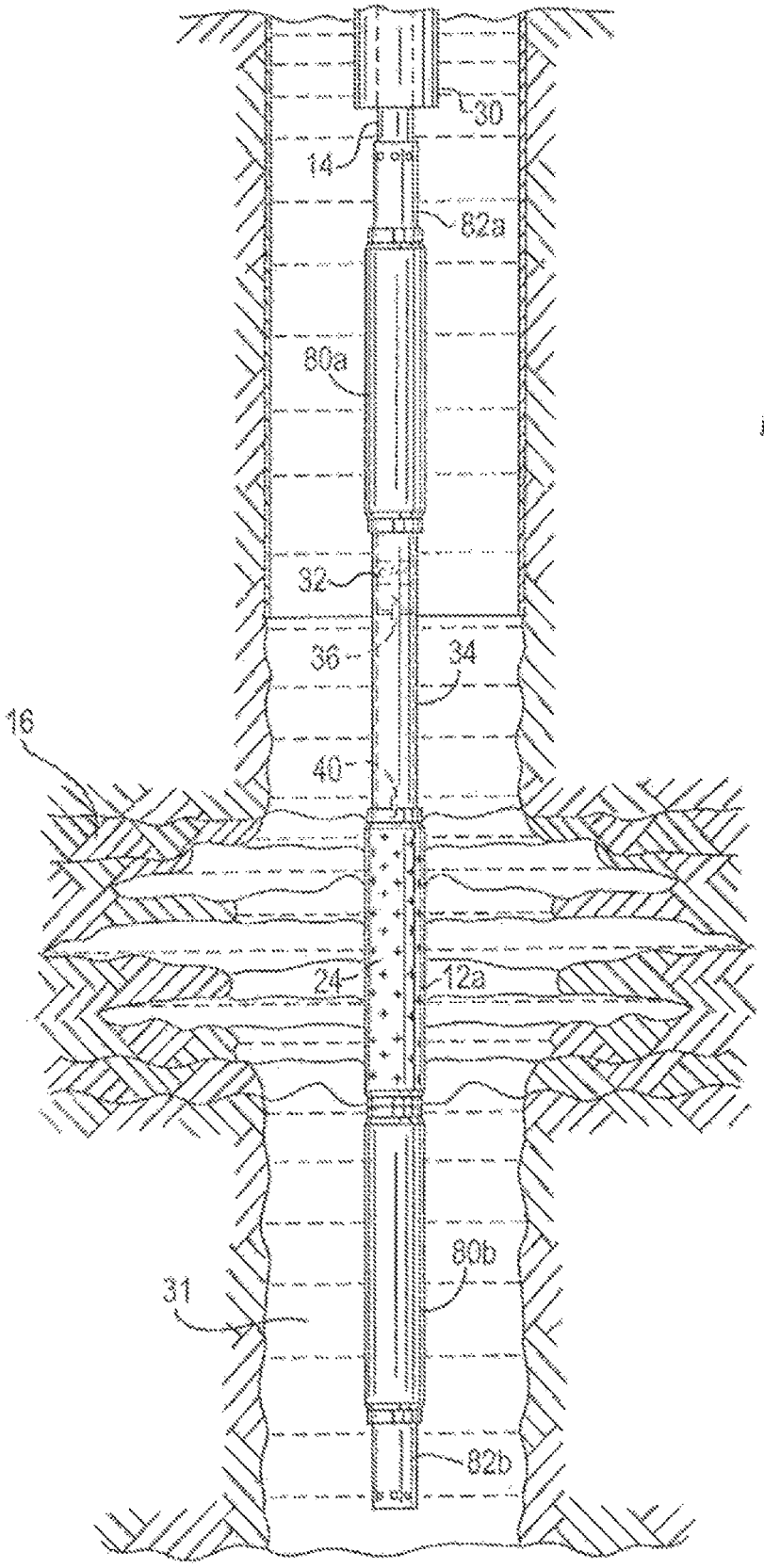
FIG. 21 is an elevation view, partly in cross-section, similar to FIG. 20, illustrating the apparatus in position so that the central balloon is aligned with the target zone.

With reference to FIG. 21, the uphole inflatable packer 80*a* and its electric pump 82*a* are positioned above the circulation valve 32. The downhole inflatable packer 80*b* and its associated electric pump 82*b* are positioned below the inflating container 24.

Figure 22:
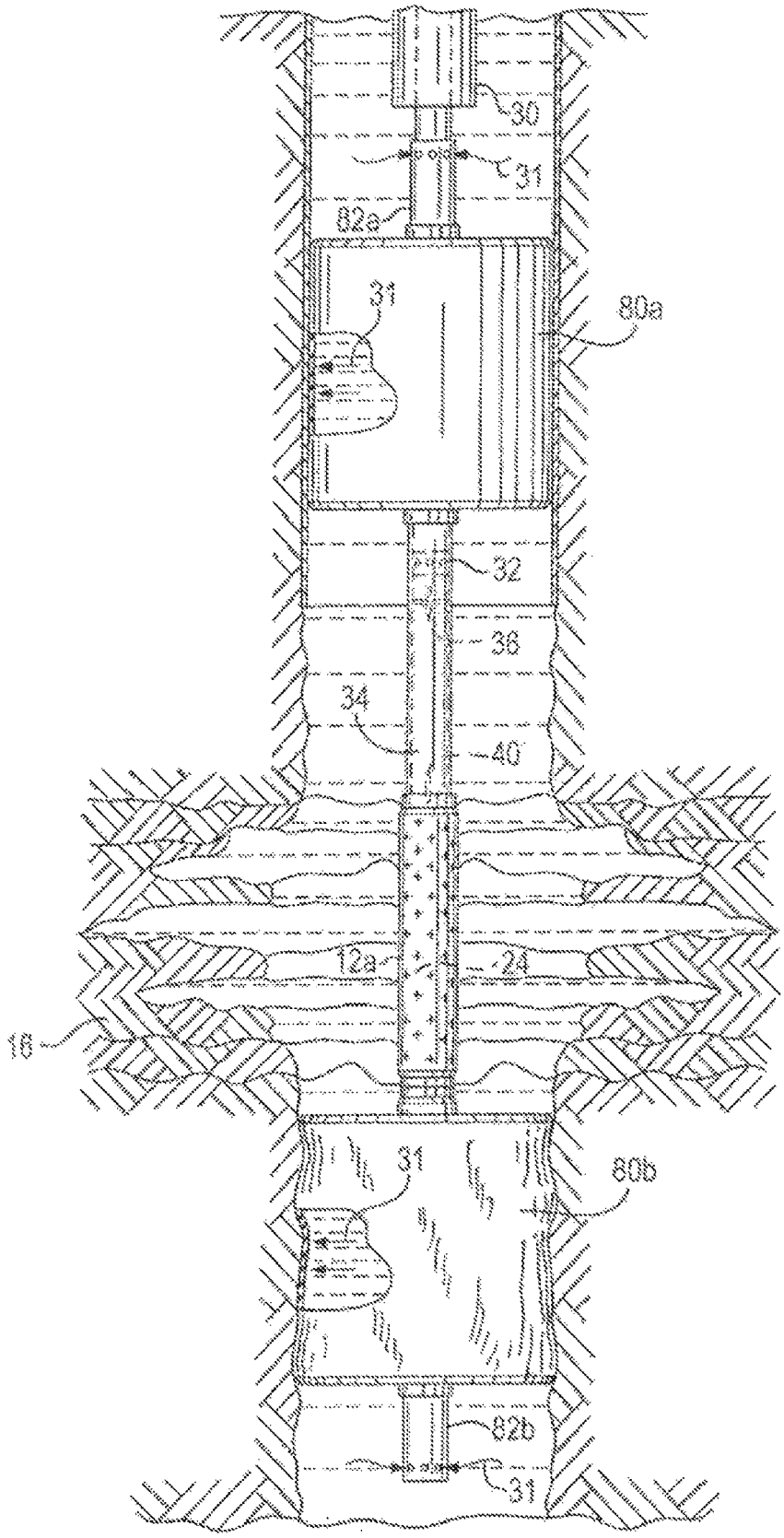
FIG. 22 is an elevation view, partly in cross-section, similar to FIG. 21, illustrating inflation of the uphole and downhole inflatable packers by their respective electric pumps.

FIG. 22 illustrates the inflation of the uphole and downhole inflatable packers 80*a* and 80*b* via electric pumps 82*a*, 82*b*, which draw wellbore fluid 31 from the wellbore and discharge it under pressure into the inflatable packers 80*a*, 80*b*. When inflated, the uphole and downhole packers 80*a*, 80*b* expand into secure contact with the wellbore wall surface to maintain the assembly in a fixed position and to isolate the target zone 16 from wellbore fluids above and below the assembly.

Figure 23:
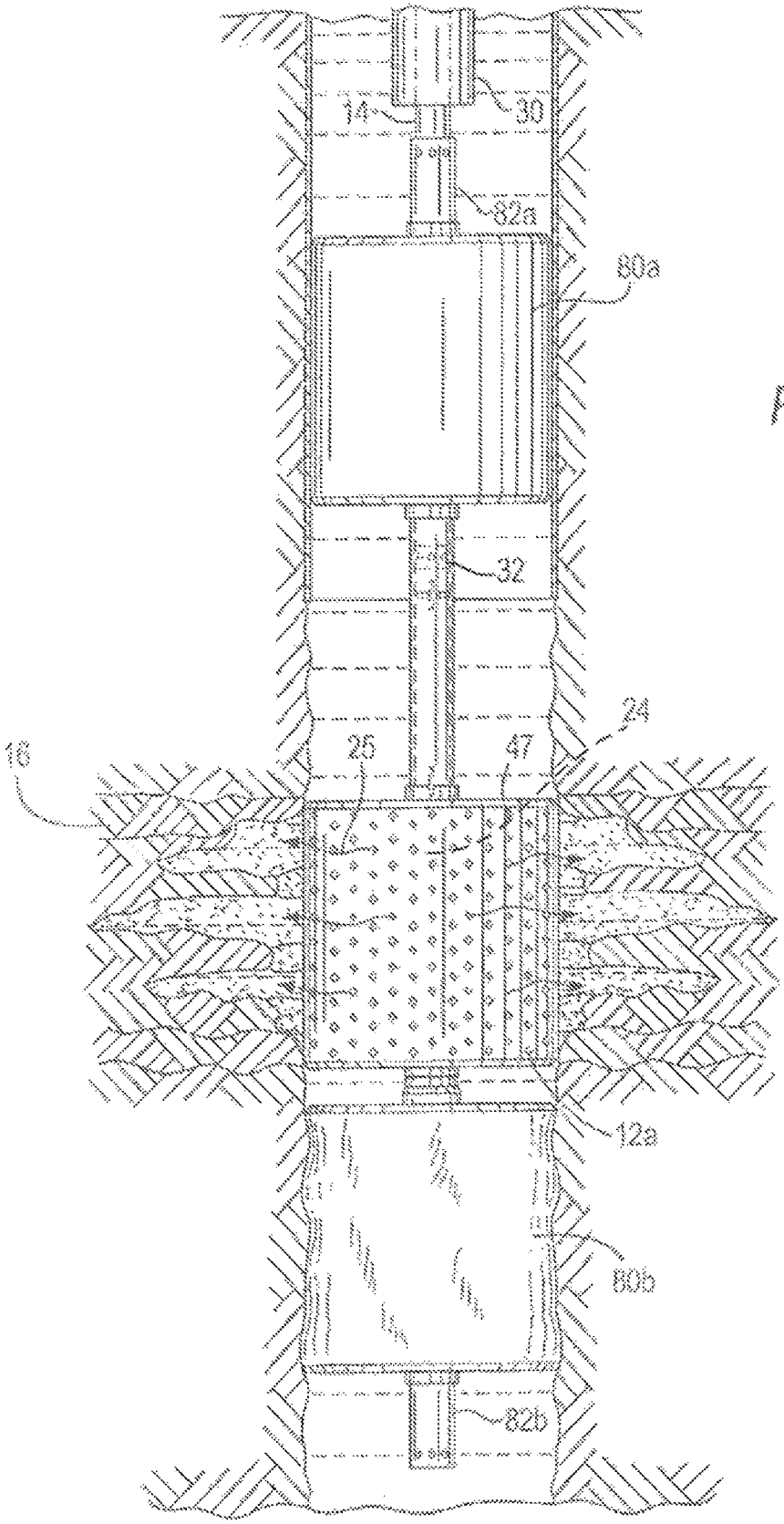
FIG. 23 is an elevation view, partly in cross-section, similar to FIG. 22, illustrating the passage of plugging fluid through the ruptured weakened portions of the inflated central balloon to penetrate the formation in the target zone.

With reference to FIG. 23, once the uphole and downhole inflatable packers 80*a*, 80*b* have been inflated, the inflation of the central balloon 12*a* is initiated in the same manner as described above with respect to FIG. 2B. The central balloon 12*a* is inflated by the reaction products (not shown) which force the formation plugging fluids 25 out of the inflating container and into the balloon so that the weakened sections 47 of the central balloon 12*a* rupture, allowing the formation plugging fluids 25 to flow through the ruptured weakened sections 47 and penetrate the formation in the target zone 16. The inflated central balloon 12*a* continues to expand and is softened and is melted by the heat of the reaction in the same manner that was described above with respect to FIG. 15 so that inflated central balloon 12*a*, which is in contact with the walls of the target zone 16, melts against the wall of the well, thereby sealing the target zone 16. In this embodiment, the central balloon 12*a* is supported against the wall of the well by one or more of the above-described structural elements such as the straps or bands of rigid high tensile material 42, the expandable ratchet ring 44, and the expandable metal stent 70. The remnants of the central balloon are separated along the circumferentially weakened lines.

After the target zone 16 has been sealed, the uphole and downhole inflatable packers 80*a*, 80*b* are deflated by the electric pumps 82*a*, 82*b*, which withdraw the wellbore fluid 31 from their respective packers and return it to the wellbore. Once the uphole and downhole packers 80*a*, 80*b* are sufficiently deflated, the apparatus is removed from the wellbore through the production tubing 30 via the coiled tubing 14.

The sequence of process steps can be summarized in conjunction with reference the drawings as follows:

FIG. 1 shows the apparatus in the initial state of its downhole deployment adjacent to the target zone 16 in the wellbore 11.

Figure 10:
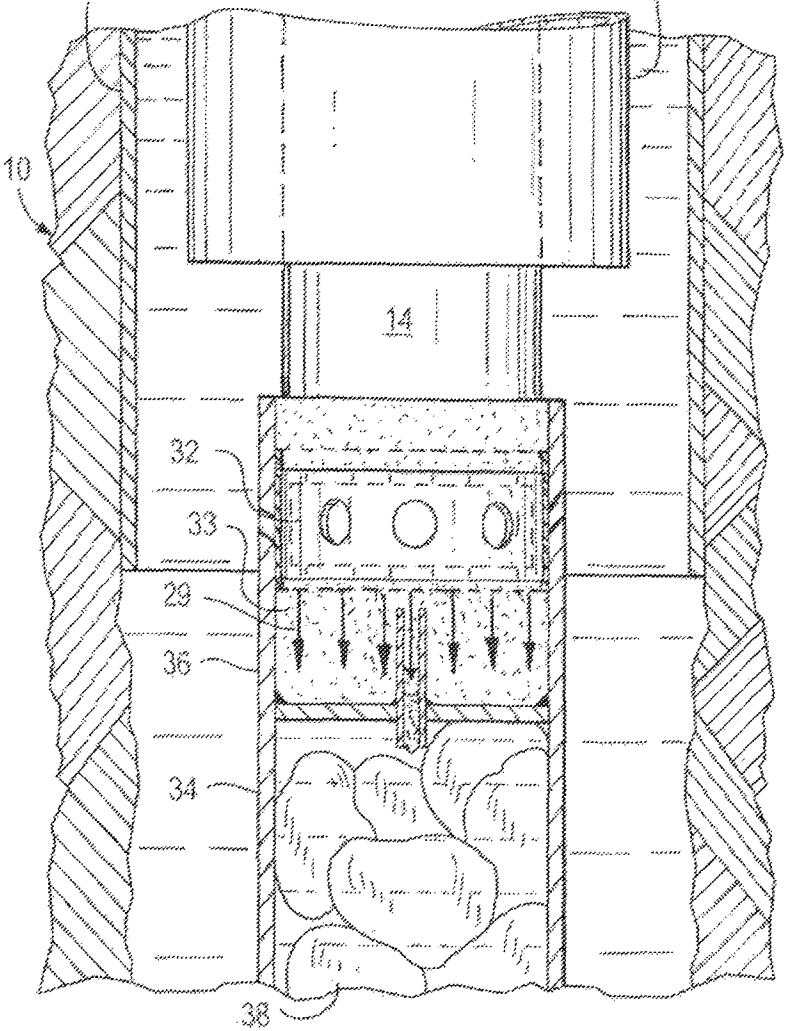
FIG. 10 is an enlarged elevation view of a timed circulation valve secured in fluid communication via a pressure-operated valve to the chemical container filled with a reactant material.

FIGS. 2A and 2B show the function of the timed circulation valve 32 which is kept open to facilitate deployment of the apparatus 10, while the tool is lowered into the borehole so that wellbore fluids 31 enter the coiled tubing 14. Once the balloon 12 reaches the target zone, the activating fluid reactant 33 pressurized by the displacing liquid (not shown) is pumped from the surface into the coiled tubing 14 to displace the wellbore fluids 31 through the timed circulation valve 32. Once the activating fluid reactant 33 reaches the circulation valve 32 depth and the wellbore fluids 31 have been displaced, the circulation valve 32 automatically closes. Additional displacing fluid is pumped into the coiled tubing 14 from the surface in order to increase the pressure to a sufficient level to open the pre-set pressure-operated uphole inlet valve 36. As shown in FIG. 10, when inlet valve 36 opens, the activating fluid reactant 33 enters the chemical container 34 to produce the reaction with the chemical(s) 38.

As shown in FIG. 11, the fluid reactant 33 enters the chemical container 34 via uphole pressure-operated inlet valve 36 to initiate the reaction. The pressure of the reaction causes pressure-operated exit valve 40 to open, allowing the reaction products 29 to enter the inflating container 24.

Figure 12:
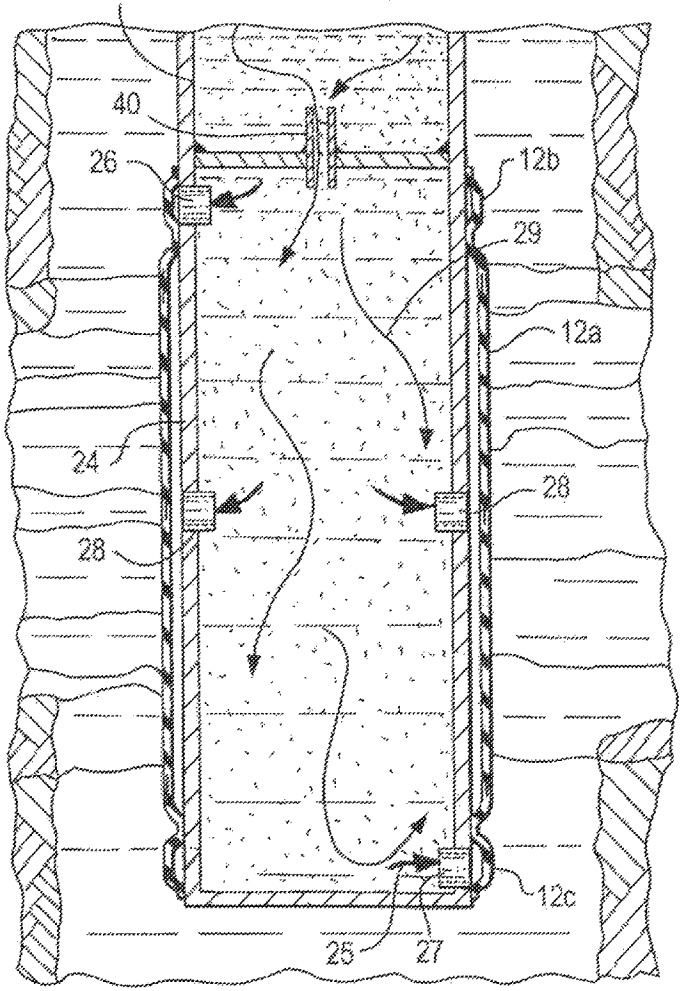
FIG. 12 is a cross-sectional view similar to FIG. 11 showing the downhole pressure-operated valve advanced to the open position to permit entry of the reaction products from the chemical container to the inflating container to thereby displace the formation plugging material while separately inflating the three chemical balloons.

In FIG. 12, the hot reaction products 29 from the chemical container 34 enter the inflating container 24 through the downhole pressure-operated valve 40 displacing the formation plugging fluid 25 into the balloons 12. The reaction products 29 pass through the pressure-operated inflation valves 26, 27, and 28 and the sequential full expansion of the balloon sections 12*b*, 12*c*, and then 12*a* occurs as described in detail above in the discussion of FIGS. 13 and 14. Initially, uphole balloon 12*b* and downhole balloon 12*c* expand until they reach the wall surface and seal the adjoining annulus, while stabilizing the entire device during completion of the expansion of central balloon 12*a*, and its eventual melting and rupturing to secure the remnants to the wall of the wellbore.

FIG. 15 shows the path of the formation plugging fluid 25 and the reaction products 29 through the pressure-operated inflation valves 28. Specifically, the reaction products 29 force the formation plugging fluid 25 through the pressure-operated inflation valves 28 and then through the weakened sections 47 of the balloon (not shown). The reaction products 29 follow the same path through the pressure-operated inflation valves 28 and the weakened section 47 (of the balloon not shown).

FIG. 16 illustrates the removal of the apparatus from the wellbore 11 through production tubing 30 after the wall has been plastered with, and sealed by the melted balloon 120*a* and end balloons 120*b*, 120*c* have been ruptured. It is noted that the remaining portions of the end balloon, 120*b* (not shown) and 120*c*, which are attached to inflating container 24, are removed with the coiled tubing 14 (not shown).

Figure 24:
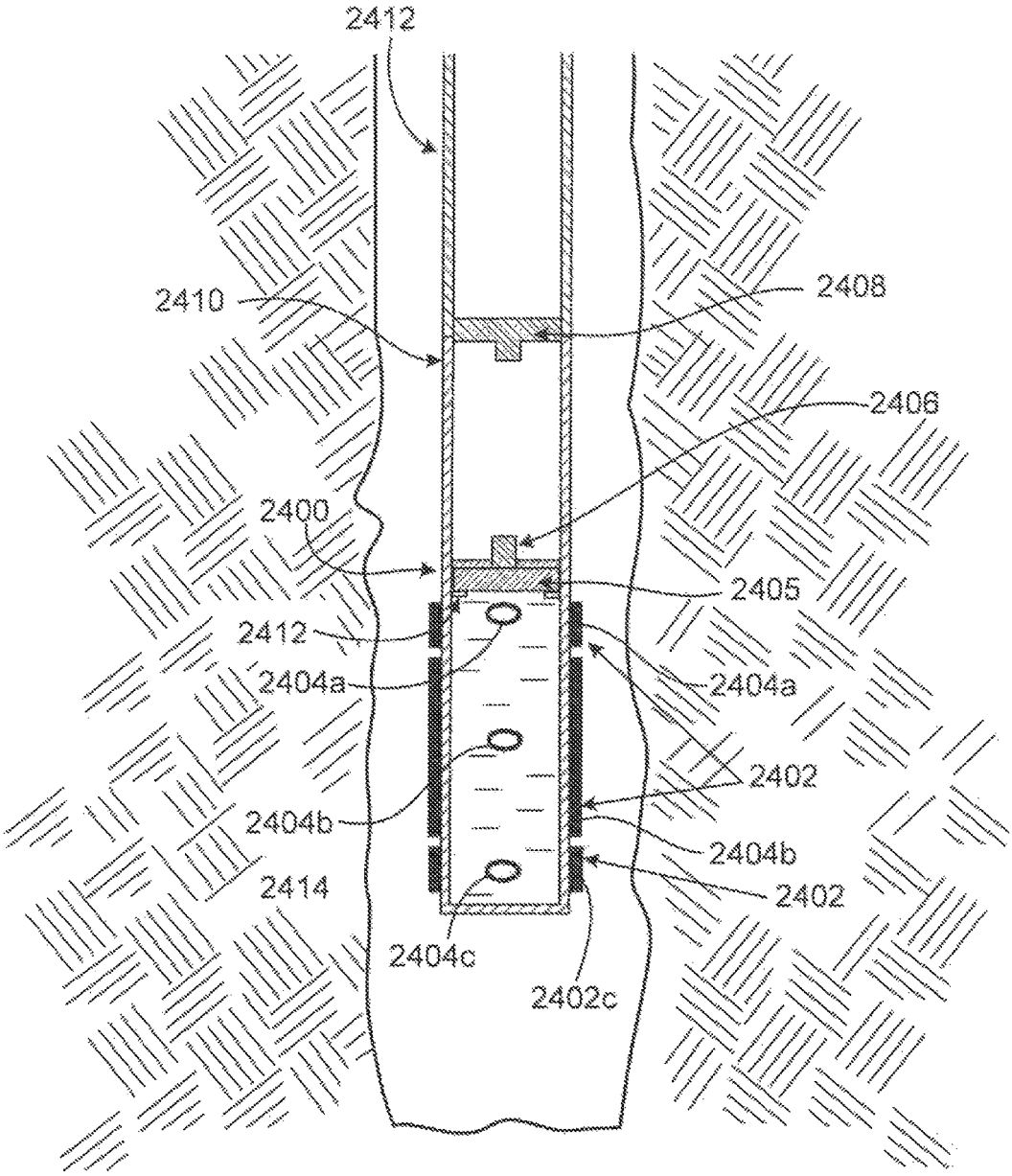
FIG. 24 is a schematic view of another implementation of a balloon which forms part of the apparatus of FIG. 1 and delivers formation plugging fluid to the target zone.

FIG. 24 is a schematic view of another implementation of a balloon system which, in some implementations, forms part of the apparatus of FIG. 1 and delivers formation plugging fluid to the target zone. Similar to the balloon system described earlier, the balloon system shown in FIG. 24 includes a container 2400 that contains (for example, is filled with) the formation plugging fluid 2414. In some implementations, three balloons—an uphole balloon 2402*a*, a central balloon 2402*b*, and a downhole balloon 2402*c*—are secured in position on the outside surface of the container 2400, for example, by an adhesive. The uphole balloon 2402*a* is uphole relative to the central balloon 2402*b*, which is uphole relative to the downhole balloon 2402*c*. The three balloons 2402*a*, 2402*b*, and 2402*c* can be made of any suitable flexible thermoplastic expandable material, for example, a polymer, and preferably rubber, natural, or synthetic. Different flexible and resilient materials can be used for each of the three balloons. The individual balloons can be produced with different wall thicknesses, physical properties, and means for attachment to their supporting surface. The thickness and resiliency of the walls, or sections of the walls of the respective balloons is sufficient to permit the expansion and secure contact with the adjacent wall surface.

Uphole of the container 2400 is a compressed gas container 2410 that contains (for example, is filled with) a compressed, flammable gas. Alternatively or in addition, the compressed gas container 2410 can be any container that contains (for example, is filled with) a solid explosive that can be ignited to release rapidly expanding gas at a high temperature. A firing system 2408, described later, is connected to an uphole end of the compressed gas container 2410. A downhole end of the compressed gas container 2410 and an uphole end of the container 2400 are fluidically coupled such that, upon expansion, gas in the compressed gas container 2410 can flow in a downhole direction toward the container 2400. The container 2400 and the compressed gas container 2410 are fluidically coupled by a pressure-operated valve 2406. The valve 2406 is configured to open when the pressure on the compressed gas container 2410 reaches a pre-determined value. The open valve 2406 opens a fluidic passage from the compressed gas container 2410 to the container 2400.

The container 2400 includes multiple ports to inflate the balloons; in some implementations, as many ports as balloons. For example, an uphole port 2404*a*, a central port 2404*b*, and a downhole port 2404*c* are formed on the container 2400 to inflate the uphole balloon 2412*a*, the central balloon 2412*b*, and the downhole balloon 2412*c*, respectively. The container 2400 includes a floating piston 2405 at an uphole end of the container 2400, for example, immediately downhole of the valve 2406. The floating piston 2405 rests on shearing pins 2412 attached to an inner wall of the container 2400 and is protruding radially inward. In response to a downhole movement of the floating piston 2404, the shearing pins 2412 can open the ports and be sheared to permit movement of the floating piston 2405 in the downhole direction. The balloon system can be deployed by coiled tubing 2406 and used to induce permanent skin damage to the surface and the adjoining region of the undesirable water zone as described later.

The balloons described with reference to FIG. 24 are inflated by a controlled explosion that ignites the compressed flammable gases in the compressed gas container 2410. The ignited gas increases the pressure in the compressed gas container 2410 to the pre-determined value causing the pressure-operated valve 2406 to open the fluidic passage from the compressed gas container 2410 to the container 2400. The ignited gas applies a force in a downhole direction on the floating piston 2405. The force causes the shearing pins 2412 to open the ports and to shear, allowing the piston 2405 to travel toward the downhole end of the container 2400. The open ports cause the formation plugging fluid 2414 to inflate the balloons until an outer surface of the balloons contacts and presses against the inner wall of the well. As described later, in some implementations, a rate at which the three balloons expand can be controlled such that the formation plugging fluid 2414 is sprayed on the wall of the well. The ignited gas heats and melts the balloons against the wall of the well, thereby sealing a portion of the well.

In some implementations, the three balloons can inflate at different times or at different rates or both. For example, the uphole and downhole balloons 2402*b* and 2402*c* can inflate first to provide tight seals against the wall of the well at either end of the central balloon 2402*b*, thereby acting as barriers to the formation plugging fluid 2414. This fluid-tight compartment will permit the formation plugging fluid 2414 to be forced deep into the formation under the pressure produced by the rapid expansion of the ignited compressible flammable gas. The central balloon 2402*b* has multiple weakened areas that will rupture at the early stages of inflation. The presence of the weakened areas or spots or the perforations can provide a slower rate of inflation of the central balloon 2402*b* relative to the uphole balloon 2402*a* and the downhole balloon 2402*c* which do not have the weakened areas or spots or the perforations. Because the balloons inflate at different rates, the uphole balloon 2402*a* and the downhole balloon 2402*c* will first create a compartment within which the formation plugging fluid 2414 will leak from the central balloon 2402*b*. After rupturing, the weakened wall will allow the passage of the formation plugging fluid 2414 from the container 2400 while allowing the balloon 2402*b* to inflate and expand radially into the annular space or compartment defined by the adjacent balloons, that is, balloons 2402*a* and 2402*c*. Alternatively or in addition, the central balloon 2402*b* can include a perforation that can delay a rate at which the central balloon 2402*b* expands relative to either or both of the uphole balloon 2402*a* and the downhole balloon 2402*c*. In addition, the perforation can allow the formation plugging fluid 2414 to be sprayed onto the wall of the well.

Figure 25:
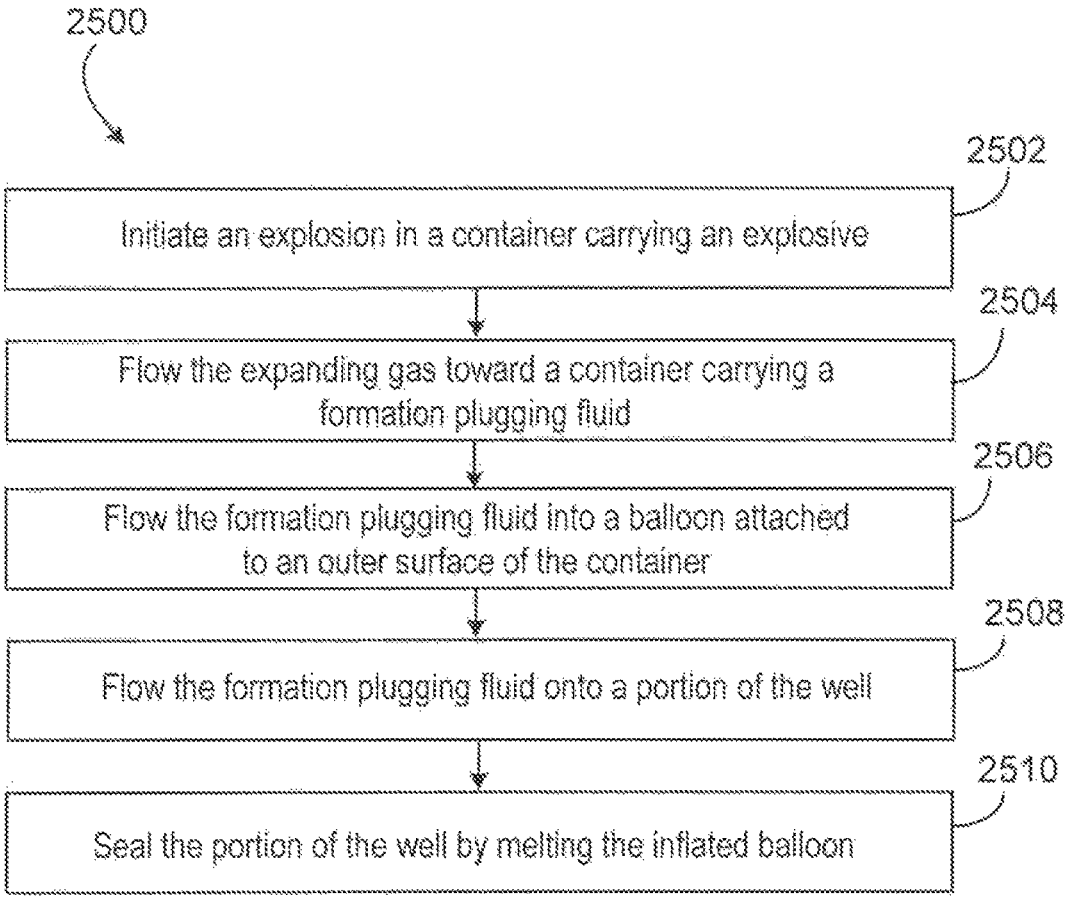
FIG. 25 is a flowchart of an example of a process for sealing an undesirable formation zone in the wall of a well.

FIG. 25 is a flowchart of an example of a process 2500 for sealing an undesirable formation zone in the wall of a well. The process 2500 can be implemented using the balloon system described with reference to FIG. 24. Initially, the balloon system can be lowered into a wellbore using coiled tubing in a rig-less operation. For example, using the coiled tubing 2412, the balloon system can be lowered into the well to a well portion through which undesirable fluids are leaking into the wellbore.

At 2502, an explosion can be initiated in a container carrying an explosive, for example, the container 2410. The explosion can expand gas in the container causing the expanding gas to flow toward another container, for example, the container 2400 carrying formation plugging fluid configured to prevent fluid flow through the formation. For example, the explosion can be initiated by triggering a firing mechanism (such as a perf gun or other firing mechanism) causing an ignition of the explosive (such as compressed flammable gas or solid explosive or other explosive). As the gas expands, the pressure on the container 2410 increases to satisfy a threshold pressure at which the pressure valve 2405 opens.

At 2504, the expanding gas is flowed to the container carrying the formation plugging fluid. For example, when the pressure on the container 2410 exceeds the threshold pressure at which the pressure valve 2405 opens, the expanding gas flows into the container carrying the formation plugging fluid.

At 2506, the formation plugging fluid is flowed into a balloon attached to an outer surface of the container. For example, the floating piston 2405, positioned at an end of the container 2400 through which the expanding gas enters the container 2400, is pushed toward the opposite end by a force of the gas. The floating piston 2405 pushes the shearing pins 2412 opening the ports on the container and shearing the shearing pins 2412. The floating piston 2405 pushes the formation plugging fluid out of the ports on the container (for example, the port 2404*b*) and into the balloon (for example, the central balloon 2402*b*). The balloon is inflated as the formation plugging fluid flows into the balloon.

Figure 26:
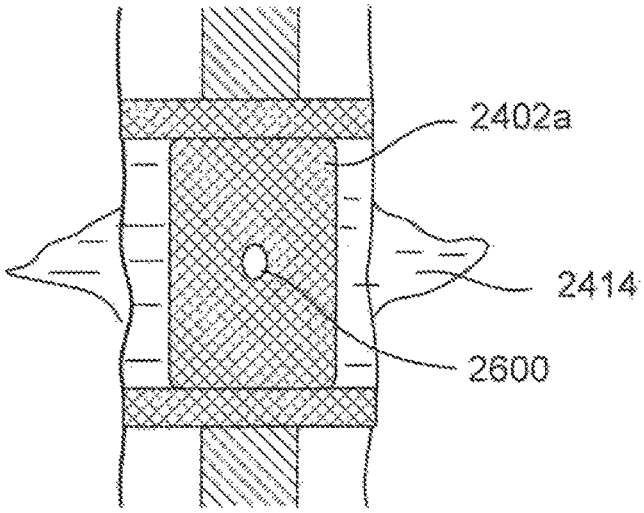
FIG. 26 is a schematic view of a central balloon with a hole.

At 2508, the formation plugging fluid is flowed onto a portion of the well. FIG. 26 is a schematic view of a central balloon 2402*a* with a hole 2600. For example, the formation plugging fluid flows through the hole 2600 onto the inner wall of the wall. In another example, the central balloon 2402*b* can include weakened sections configured to rupture as the central balloon 2402*b* inflates. Combinations of a hole (or holes) and weakened sections are also possible.

Figure 27:
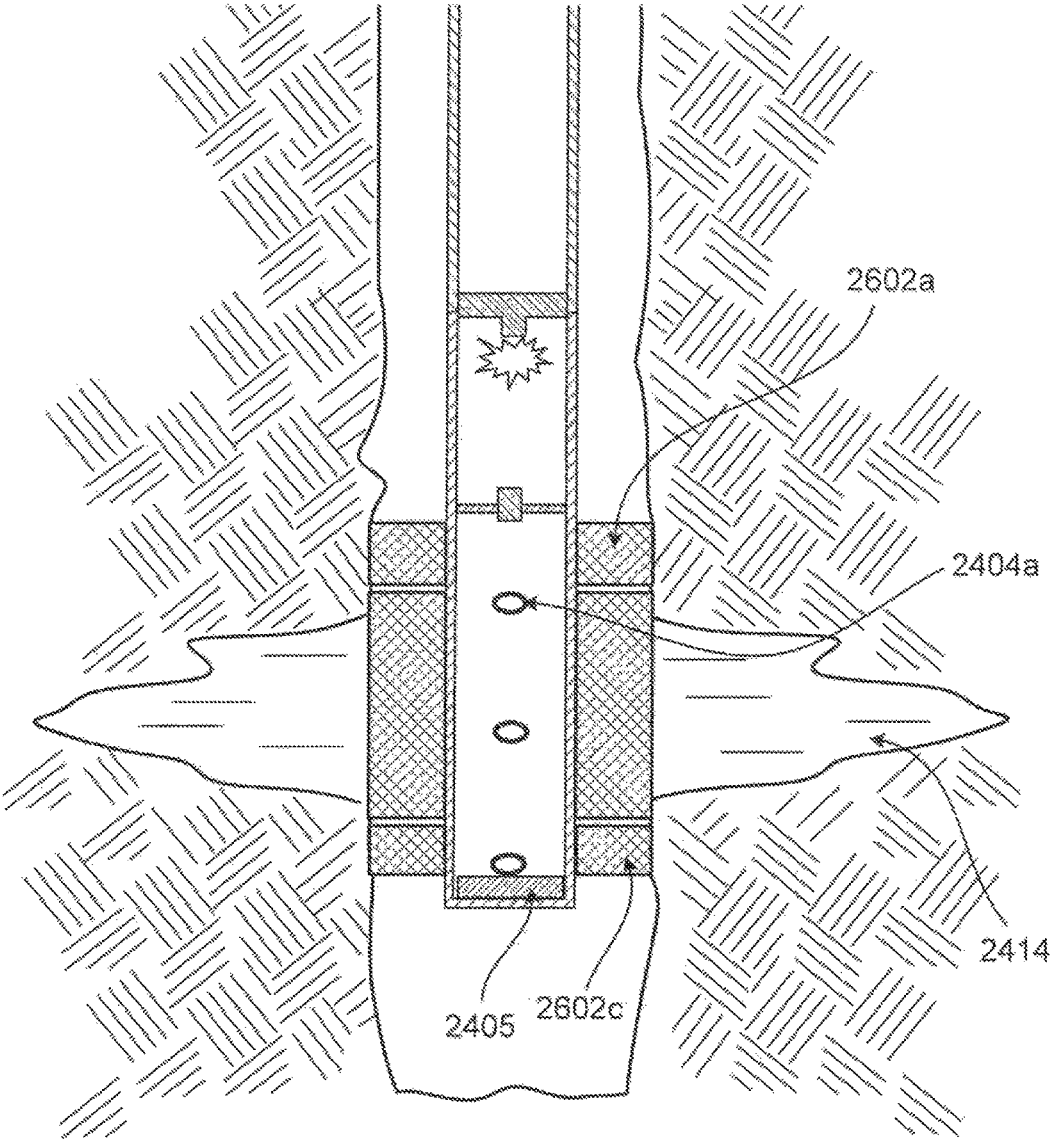
FIG. 27 is a schematic view of inflated balloons contacting the wall of the well.

At 2510, the portion of the well is sealed by melting the inflated balloon. FIG. 27 is a schematic view of inflated balloons contacting the wall of the well. As described earlier, the formation plugging fluid has been sprayed onto the wall of the well. Subsequently, the central balloon 2402*b* has been inflated to contact the well, thereby trapping the formation plugging fluid between the well and the central balloon 2402*b*.

In some implementations, an uphole balloon 2402*a* and a downhole balloon 2402*c* can be attached to the container 2400 as explained earlier. The uphole balloon 2402*a* and the downhole balloon 2402*c* expand faster than the central balloon 2402*b* when the formation plugging fluid flows into the uphole balloon 2402*a* and the downhole balloon 2402*c* through the uphole port 2404*a* and the downhole port 2404*c*, respectively. FIG. 27 shows an inflated uphole balloon 2602*a* and an inflated downhole balloon 2602*c* when the floating piston 2405 has been pushed to the opposite end of the container 2400. Because the inflated uphole balloon 2602*a* and the inflated downhole balloon 2602*c* do not include holes for the formation plugging fluid to flow through, the inflated uphole balloon 2602*a* and the inflated downhole balloon 2602*c* form a seal uphole of and downhole of the central balloon 2402*b*. Such sealing creates a flow channel for the formation plugging fluid to be directed to the portion of the well near the central balloon 2402*b*. In some implementations, the uphole balloon 2402*a* and the downhole balloon 2402*c* can be fluidically isolated from the central balloon 2402*b* such that the formation plugging fluid does not flow from either the uphole balloon 2402*a* or the downhole balloon 2402*c* to the central balloon 2402*b*. In some implementations, the uphole balloon 2402*a* and the downhole balloon 2402*c* can be fluidically isolated from each other. In some implementations, the uphole balloon 2402*a* and the downhole balloon 2402*c* can be fluidically coupled to each other to share a fluidic pathway through which the formation plugging fluid flows to each balloon.

Figure 28:
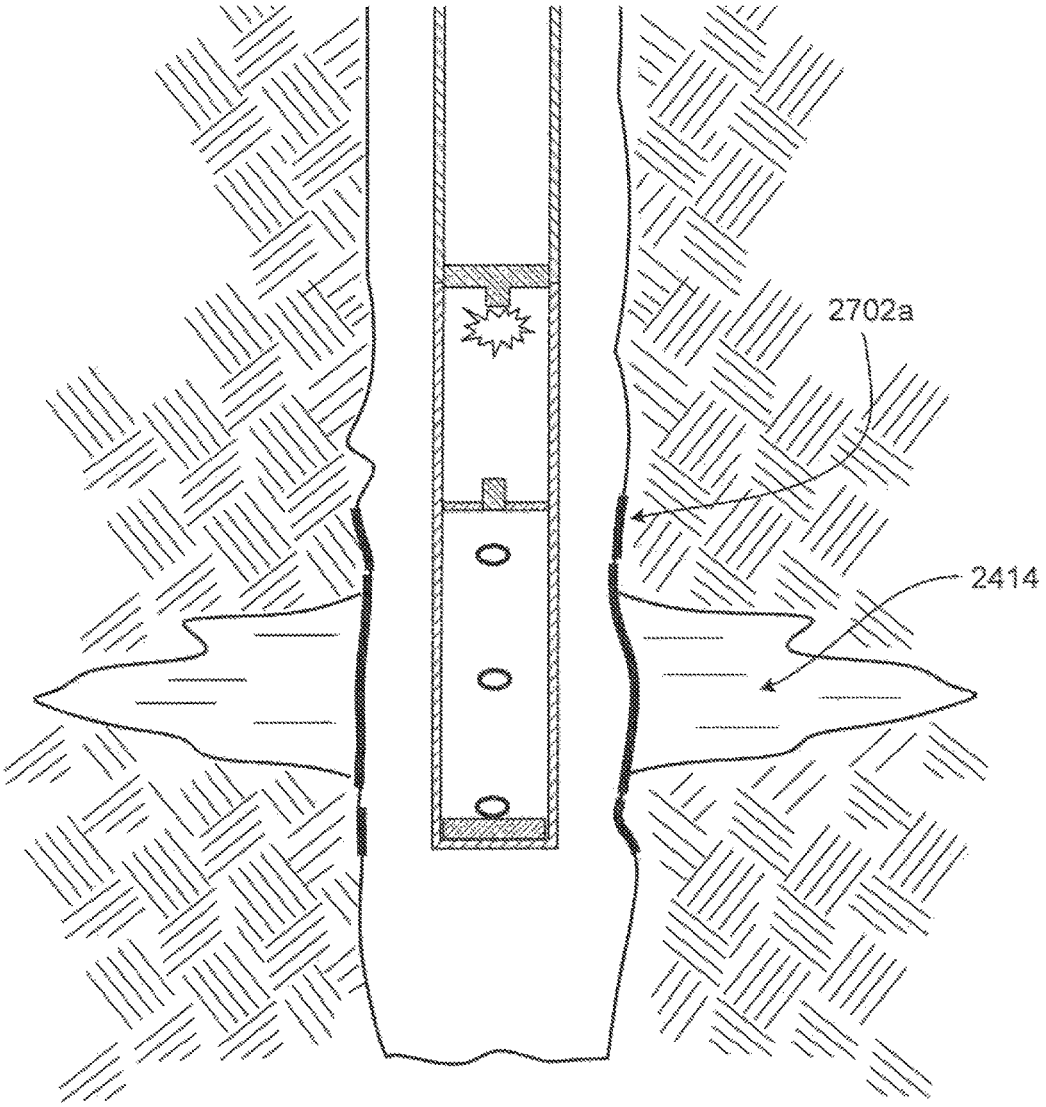
FIG. 28 is a schematic view of melted balloons sealing formation plugging fluid in the wall of the well.

Returning to FIG. 26, at 2510, the portion of the well is sealed by melting the inflated balloon. FIG. 28 is a schematic view of melted balloons sealing formation plugging fluid in the wall of the well. After the inflated balloon has contacted the inner wall of the well, the heat from the expanding gas can melt the balloon (for example, melted balloon 2702*a*), thereby separating the balloon from the container 2400 and retaining the melted balloon against the inner wall of the well. In some implementations, ratchet rings (for example, ratchet rings 44 described earlier) can be implemented to expand with the balloons to provide circumferential support following the completed inflation of the central balloon against the wall. In this manner, the portion of the well through which an undesirable fluid leaks, is sealed off in a rigless operation.

In the exemplary balloon system described with reference to FIG. 24, direction of movement, for example, of the expanding gas and of the floating piston, is described as being in a downhole direction. The exemplary balloon system can alternatively be implemented such that the direction of movement is in an uphole direction. For example, the balloon system can be inverted such that the firing system 2408 is at a downhole end of the balloon system, and the compressed gas container 2410 is downhole relative to the container 2400 carrying the formation plugging fluid 2414. Alternatively, the balloon system can be implemented horizontally or in an angular orientation relative to a surface in which the well is formed.

In some implementations, multiple balloon systems can be implemented, for example, at different depths from the surface at which fluid is leaking into the formation. In such implementations, each balloon system can be activated using chemicals as described earlier or using explosives as described earlier. Alternatively, one or more of the multiple balloon systems can be activated using chemicals, while remaining balloon systems can be activated using explosives.

By implementing the techniques described earlier with reference to FIGS. 24-28, a need to flow chemicals (or other materials) from a surface to inflate the balloons can be avoided. Instead, the firing system and the explosive can attach to the container 2400 at the surface, and the entire balloon system can be lowered into the well. In such a balloon system, all components needed to inflate the balloons are positioned within the well, and need not be transported downhole from the surface. Also, techniques have been described here in the context of sealing a portion of a well to prevent flow of undesirable fluids. Similar techniques can be used to seal off portions of the well for other purposes as well.

The method and system of the present disclosure have been described above and in the attached drawings; however, modifications derived from this description will be apparent to those of ordinary skill in the art and the scope of protection for the disclosure is to be determined by the claims that follow.

The invention claimed is:

1. A method comprising:

initiating an explosion in a first container carrying an explosive, the first container positioned inside a well formed in a formation, the explosion expanding gas in the first container, wherein an expansion of hot gas flows toward a second container fluidically connected to the first container, the second container carrying formation plugging fluid configured to prevent fluid flow through the formation; and using the expansion of hot gas:

flowing the formation plugging fluid out of the second container into a balloon attached to an outer surface of the second container, inflating the balloon, wherein at least a portion of the formation plugging fluid is entrapped between an inner wall of the portion of the well and the balloon, and sealing the portion of the well by melting the inflated balloon.

2. The method of claim 1, wherein initiating the explosion comprises directing a spark toward the explosive.

3. The method of claim 1, wherein the explosive is a solid explosive or a compressed flammable gas.

4. The method of claim 1, further comprising flowing the expansion of hot gas from the first container into the second container in response to a pressure on the first container satisfying a threshold pressure on the first container.

5. The method of claim 1, wherein, using the expansion of hot gas, flowing the formation plugging fluid out of the second container into the balloon attached to the outer surface of the second container comprises:

applying a force on a piston in the second container, the piston causing the formation plugging fluid to flow through a port in the second container into the balloon.

6. The method of claim 1, wherein, using the expansion of hot gas, inflating the balloon, wherein at least a portion of the formation plugging fluid is entrapped between the inner wall of the portion of the well and the balloon comprises:

flowing the formation plugging fluid through an opening in the balloon toward the portion of the well, wherein a rate of inflation of the balloon is delayed until at least a portion of the formation plugging fluid has flowed through the opening in the balloon toward the portion of the well.

* * * * *